US012036448B2

(12) United States Patent
Takehara et al.

(10) Patent No.: US 12,036,448 B2
(45) Date of Patent: Jul. 16, 2024

(54) IRON WITH SOLE SLOT

(71) Applicant: Acushnet Company, Fairhaven, MA (US)

(72) Inventors: Doug Takehara, Oceanside, CA (US); Grant Martens, San Diego, CA (US); Richard L. Cleghorn, Oceanside, CA (US); Charles E. Golden, Encinitas, CA (US); Hiroshi Kawaguchi, Aliso Viejo, CA (US); Sang Yi, Carlsbad, CA (US); Kyle A. Carr, Carlsbad, CA (US); Jonathan Hebreo, San Diego, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 0 days.

(21) Appl. No.: 17/940,841

(22) Filed: Sep. 8, 2022

(65) Prior Publication Data

US 2024/0082653 A1 Mar. 14, 2024

(51) Int. Cl.
*A63B 53/04* (2015.01)
*A63B 53/08* (2015.01)

(52) U.S. Cl.
CPC ..... *A63B 53/0433* (2020.08); *A63B 53/047* (2013.01); *A63B 53/08* (2013.01); *A63B 2053/0479* (2013.01); *A63B 2053/0491* (2013.01)

(58) Field of Classification Search
CPC ..... A63B 53/047; A53B 53/047
USPC ..... 473/324–350
See application file for complete search history.

(56) References Cited

U.S. PATENT DOCUMENTS

| | | | | |
|---|---|---|---|---|
| 7,582,024 | B2 * | 9/2009 | Shear | A63B 60/52 473/332 |
| 8,206,241 | B2 * | 6/2012 | Boyd | A63B 53/047 473/332 |
| 8,986,133 | B2 | 3/2015 | Bennett | |
| 9,044,653 | B2 * | 6/2015 | Wahl | A63B 60/52 |
| 9,101,808 | B2 * | 8/2015 | Stites | A63B 60/00 |
| 9,492,722 | B2 * | 11/2016 | Taylor | A63B 60/52 |
| 2002/0068645 | A1 * | 6/2002 | Vincent | A63B 53/047 473/338 |

(Continued)

FOREIGN PATENT DOCUMENTS

| | | | | |
|---|---|---|---|---|
| CA | 2795716 | A1 * | 10/2011 | |
| CN | 203763803 | U * | 8/2014 | A63B 53/047 |

(Continued)

*Primary Examiner* — Alvin A Hunter
(74) *Attorney, Agent, or Firm* — Cislo & Thomas, LLP

(57) ABSTRACT

A golf club head having a slot in the sole filled with an insert in which the slot is positioned close to the striking face. The slot can be a uniform distance from the striking face or the slot can curve away from the striking face in the toe region. The insert can have a uniform height or a non-uniform height. Inserts with uniform heights can have a low height profile. Inserts with non-uniform heights can have a lower height in a central portion of the insert compared to an edge portion or a perimeter portion of the insert. The insert can also have flanges or protrusions for installation into the slot. The resulting golf club head improves performance, as the sole slot with insert allows the striking face to have a profile that meets the needs at that location.

11 Claims, 17 Drawing Sheets

(56) References Cited

U.S. PATENT DOCUMENTS

| | | | | |
|---|---|---|---|---|
| 2003/0013545 | A1* | 1/2003 | Vincent | A63B 53/047 473/332 |
| 2003/0032499 | A1* | 2/2003 | Wahl | A63B 53/047 473/334 |
| 2007/0049415 | A1* | 3/2007 | Shear | A63B 53/0466 473/349 |
| 2007/0049416 | A1* | 3/2007 | Shear | A63B 53/0466 473/349 |
| 2007/0049417 | A1* | 3/2007 | Shear | A63B 53/0466 473/349 |
| 2010/0029404 | A1* | 2/2010 | Shear | A63B 60/52 473/345 |
| 2011/0151997 | A1* | 6/2011 | Shear | A63B 60/00 473/332 |
| 2012/0196701 | A1* | 8/2012 | Stites | A63B 53/06 473/324 |
| 2014/0057739 | A1* | 2/2014 | Stites | A63B 60/00 473/346 |
| 2014/0228150 | A1* | 8/2014 | Shear | A63B 60/52 473/329 |
| 2016/0107048 | A1* | 4/2016 | Shear | A63B 53/04 473/345 |
| 2017/0282020 | A1* | 10/2017 | Shear | A63B 60/00 |
| 2017/0296885 | A1* | 10/2017 | Oldknow | A63B 53/06 |
| 2019/0083866 | A1* | 3/2019 | Shear | A63B 53/0466 |
| 2019/0366164 | A1* | 12/2019 | Wahl | A63B 60/52 |

FOREIGN PATENT DOCUMENTS

| | | | | |
|---|---|---|---|---|
| EP | 3466500 | A1 * | 4/2019 | A63B 53/0408 |
| WO | WO-0243819 | A2 * | 6/2002 | A63B 53/047 |

* cited by examiner

IRON WITH SOLE SLOT

TECHNICAL FIELD

The present invention relates to a golf club irons with an improved sole portion, and, more specifically, a golf club iron having a slot adjacent to the striking face of the iron.

BACKGROUND

The flight characteristics of a golf ball after being struck by a golf club are dependent not only on the swing of the golf club but also on the golf club itself. For example, flight characteristics of the golf ball, such as fades, draws, launch angles, ball spin, speed, and the like, are impacted by the design of the golf club. By adjusting one or more design properties of the golf club, the flight characteristics of the golf ball can be improved, thereby increasing golf club performance. In some examples, adjusting a center of gravity (CG) and/or a moment of inertia (MOI) of a head of the golf club through selective weight placement impacts the flight characteristics of the golf ball. However, these weights need to be both strategically placed relative to the striking face, and properly designed. As such, improvements to weight inserts for golf club irons are desired.

Although weight inserts are crucial in helping improve the CG and MOI of the golf club head, another way to further improve the performance of a golf club head is by increasing the compliance of the golf club head upon impact with a golf ball. U.S. Pat. No. 8,986,133 to Bennett et al. illustrates how compliance can improve the performance of a metalwood type golf club.

U.S. Pat. No. 9,044,653 to Wahl illustrates the addition of a slot in an iron to improve the compliance of the golf club head, but fails to maximize the performance capabilities of such a slot by optimizing its placement as well as adding fillers.

SUMMARY

In an aspect, the technology relates to an iron-type golf club head including: a striking face having a lower leading edge; an upper topline edge opposite to the lower leading edge; a sole extending from the lower leading edge to a trailing edge rearward and distal to the lower leading edge; a back portion positioned rearward of the striking face and between the trailing edge and the upper topline edge; a slot formed in the sole adjacent to the striking face; and a weight insert disposed within the slot.

The slot has a front edge defined at the bottom surface of the sole adjacent to the striking face; a back edge defined at the bottom surface of the sole opposite the front edge towards the back portion; a proximal edge adjacent to a heel side of the golf club head; and a distal edge adjacent to the toe side of the golf club head. One or more sidewalls extend upwardly from the slot edges to further define the slot configuration. An insert can be placed inside the slot to add weight to the front portion of the golf club head in an attempt to move the center of gravity forward and/or downward relative to the same golf club head without the insert.

The slot can have various lengths and widths, and can be positioned at various distances from the striking face. Although specified in more detail below and in the accompanying drawings, in general, the slot generally has an elongated configuration in which the length is measured from the proximal edge to the distal edge in the direction of the heel to toe of the golf club. The width of the slot is smaller than the length and is generally measured from the front edge to the back edge in the front to back direction. The height of the slot is generally measured from the sole in the upward direction toward the topline edge.

In general, the slot can have a length of about 20 mm to about 85 mm. The slot can have a width of about 1 mm to about 13 mm. In an example of the present invention, the slot is maintained within the region of the striking face (in the x-direction). In another example of the present invention, the slot can enter into the toe portion of the golf club head. In another example of the present invention, the slot can extend upwardly into the toe portion of the golf club head. In another example, the slot can extend upwardly into the toe portion and curve rearwardly toward the back portion of the golf club head.

The slot is also characterized by its distance from the striking face, and more specifically, the distance from the front edge of the slot to an inner wall of the striking surface. The distance of the front edge of the slot to the inner wall of the striking face is generally 8 mm or less.

The insert is generally configured to fit inside the slot. As such, the length, width and bottom profile of the insert is substantially the same as that of the slot. The height of the insert, however, is not necessarily constrained by the profile or outline of the slot at the sole. In one example of the present invention, the height of the insert as measured from the bottom of the insert to the top of the insert can be uniform. In general, the height of the insert is less than about 5 mm. Preferably, the height of the insert is about 1 mm to about 4.5 mm.

In another example of the present invention, the insert defines a non-uniform height, meaning that the insert has a different height at different locations along the insert. For example, the insert can have a first height at a central portion that is less than a second height of the insert at an end portion. In another example, the central portion of the insert can be recessed relative to a perimeter rim portion of the insert causing a height at the perimeter rim to be greater than a height measured at the recessed central portion.

It is believed the position and configuration of the insert improves the ball speed, including when the ball is hit off-center, increases distance with increased backspin, and increases the coefficient of restitution compared with similar golf club heads without the insert described herein. This configuration may also provide a weaker loft and better peak height. Providing an insert in the slot at the location disclosed adds mass to promote deflection in the slot.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention. Furthermore, various inventive features are described below and each can be used independently of one another or in combination with other features.

Figure 1:
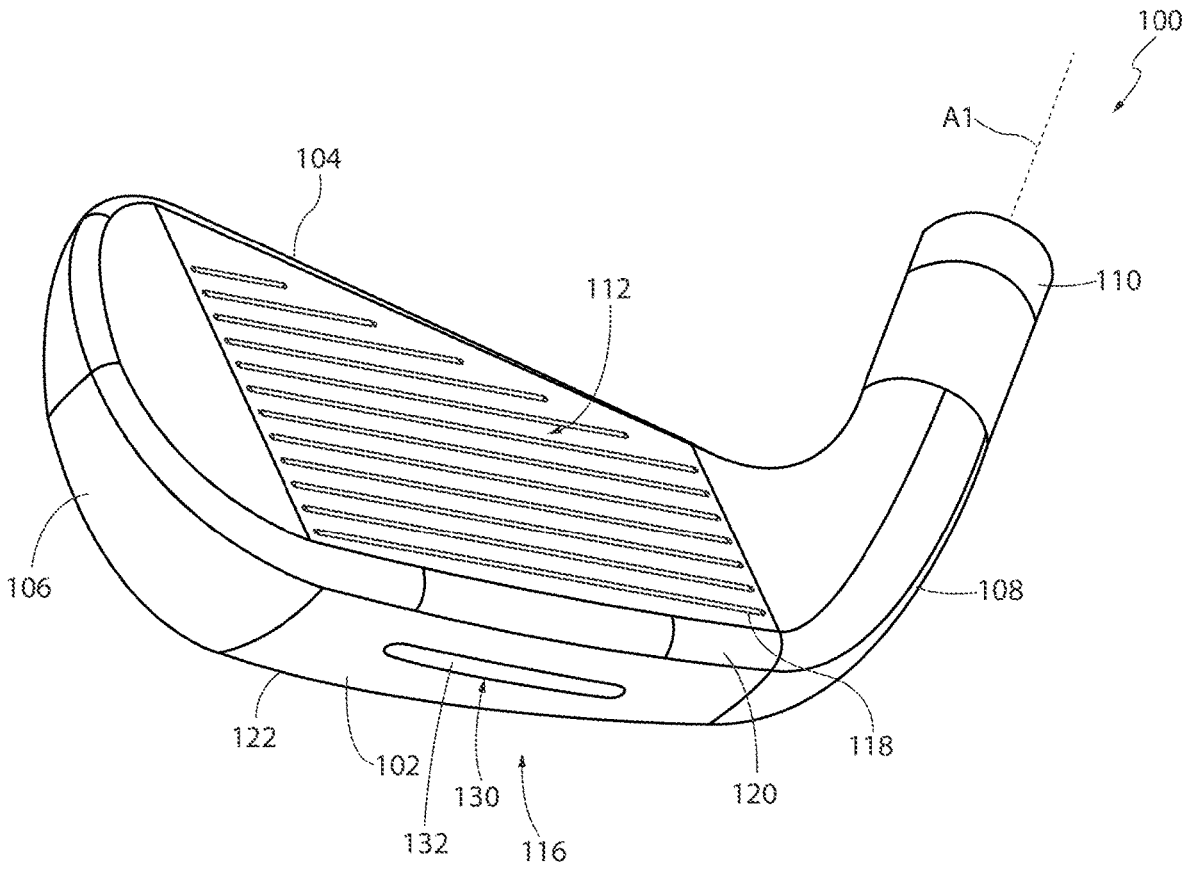
FIG. 1 of the accompanying drawings shows a perspective view of a golf club head in accordance with an exemplary embodiment of the present invention.
Figure 2:
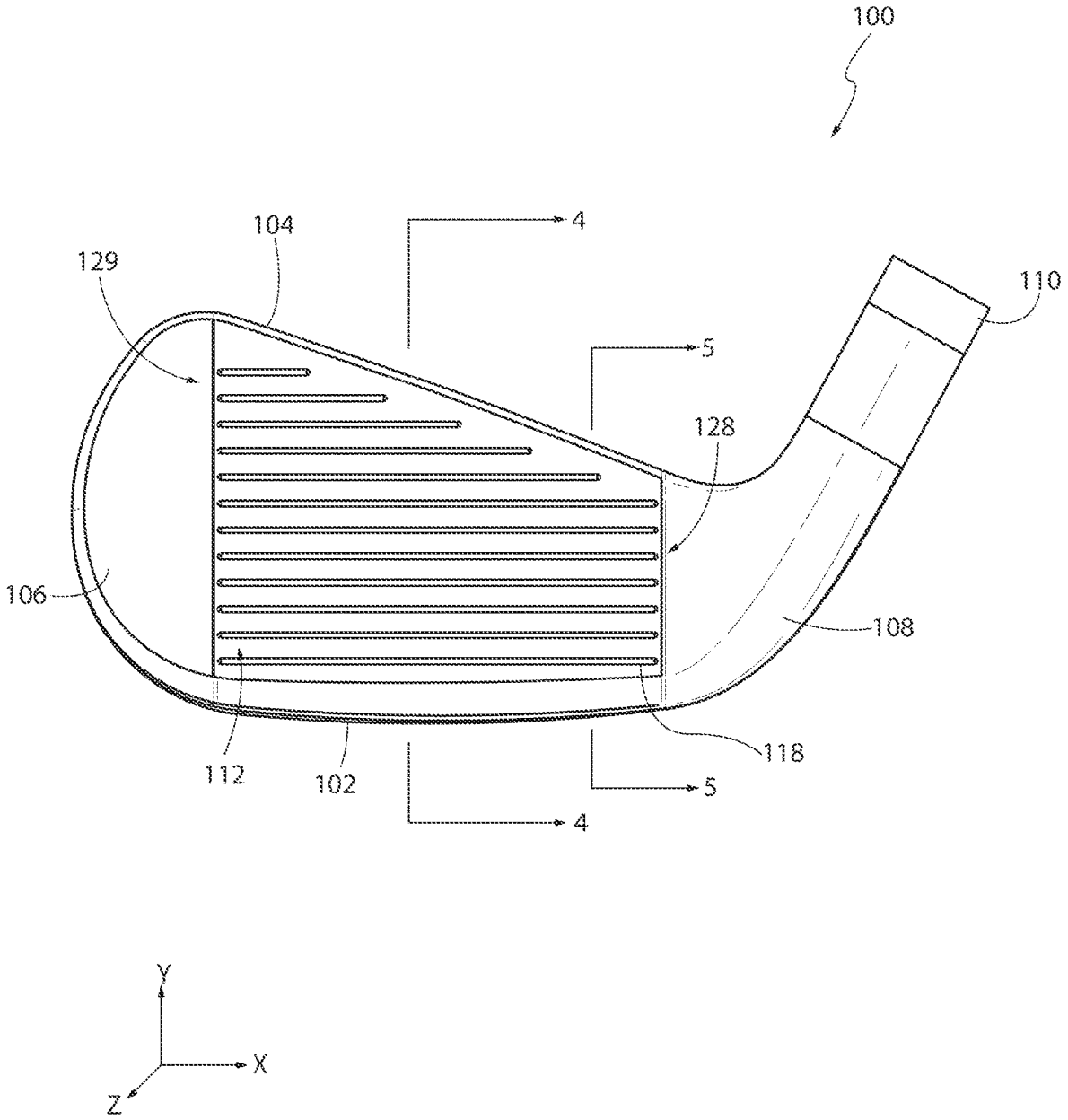
FIG. 2 of the accompanying drawings shows a front elevation view of an embodiment of the golf club head shown in FIG. 1.
Figure 3:
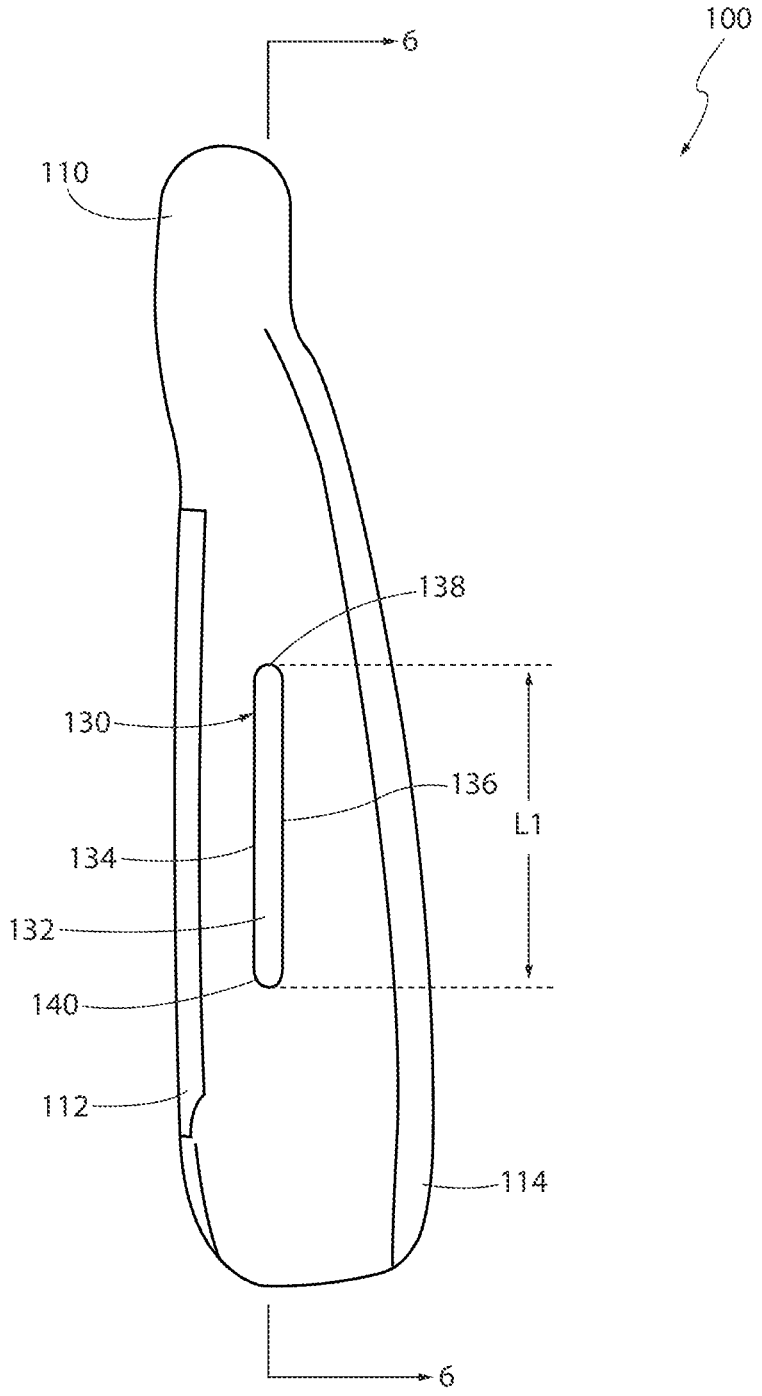
FIG. 3 of the accompanying drawings shows a bottom plan view of an embodiment of the golf club head shown in FIG. 1.

With reference to FIGS. 1-6, the golf club head 100 can be any of the various irons (including wedges and hybrids) used in the game of golf, such as the 3 iron, 4 iron, 5 iron, 6 iron, 7 iron, 8 iron, 9 iron, the pitching wedge, sand wedge, and the like. As shown in FIGS. 1-3, the golf club head 100 can generally have a sole 102; a topline 104 opposite the sole 102; a toe portion 106 adjacent to the sole 102 and the topline 104; a heel portion 108 opposite the toe portion 106 and adjacent to the sole 102 and the topline 104; a striking face 112 adjacent to the sole 102, topline 104, toe portion 106, and heel portion 108; a back portion 114 opposite the striking face 112 and adjacent to the sole 102, topline 104, toe portion 106, and heel portion 108; and a hosel 110 adjacent to the heel portion 108 and topline 104. The hosel 110 defines a longitudinal shaft axis A1 and is configured to receive a shaft. The striking face 112 can further be characterized with a plurality of horizontal scorelines 118, which helps control the spin of a golf ball that comes in contact with the striking face 112 of the golf club head 100.

For ease of description, the striking face portion 112 will be referred to as the front side of the golf club head 100. As such, the striking face portion 112 is located at a frontal portion of the golf club head 100. As a result, the back portion 114 is located behind the striking face portion 112; the topline 104 is located at an upper portion of the golf club head 100; the heel portion 108 is located at a proximal end of the golf club head 100; the toe portion 106 is located at a distal end of the golf club head 100 opposite the heel portion 108; and the sole 102 is located at a lower portion of the golf club head 100 opposite the topline 104. An axis of origin 12 is provided (for reference only for ease and clarity of description) indicating the x-y-z direction relative to the golf club head 100 in the examples provided.

Figure 4:
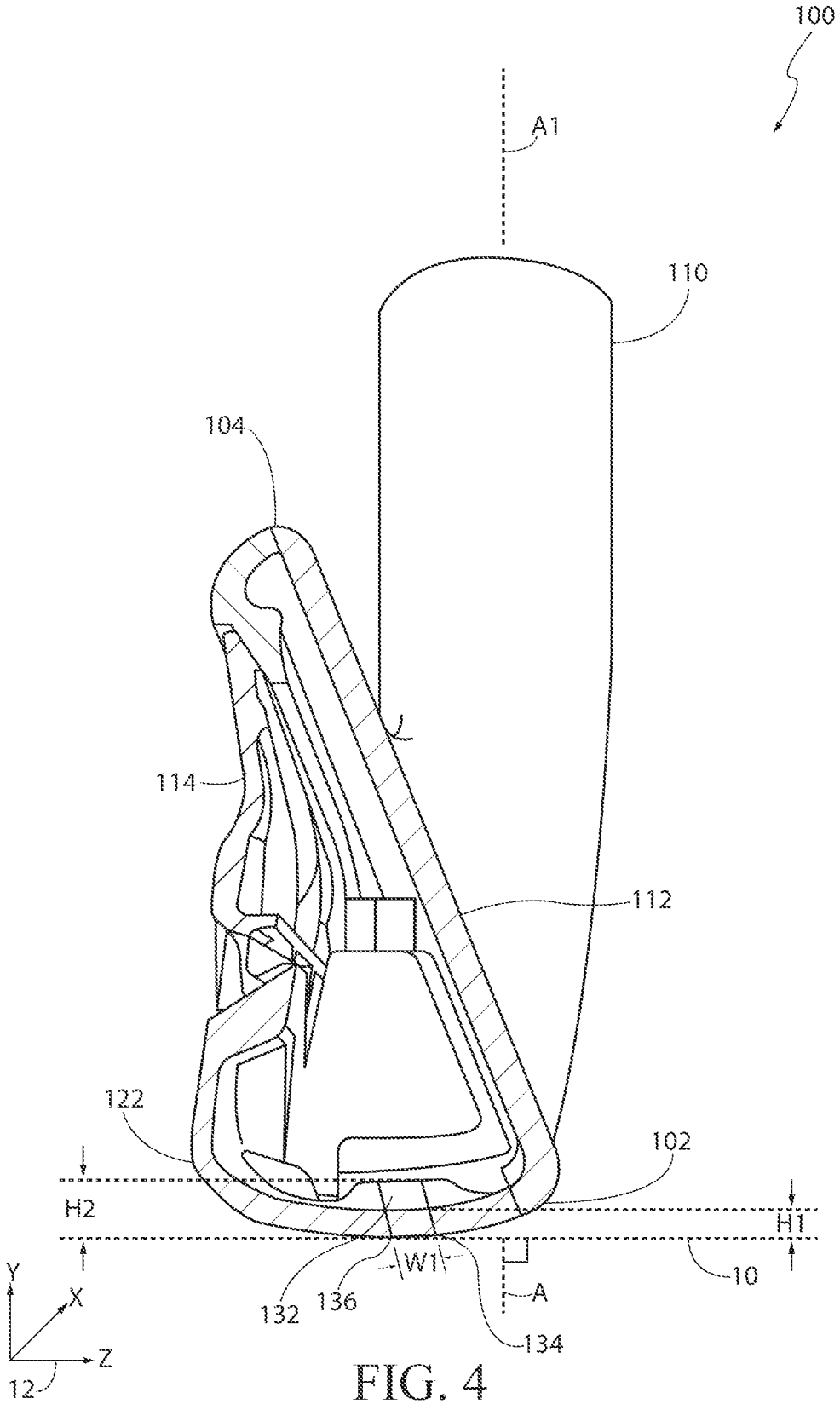
FIG. 4 of the accompanying drawings shows a cross section from a toe side view of an embodiment of the golf club head shown in FIG. 2 taken along line 4-4.

The golf club head 100 comprises a leading edge 120 located approximately where the striking face 112 meets the sole 102; a trailing edge 122 adjacent to the back portion 114 and the sole 102; and the sole 102 in between the leading edge 120 and the trailing edge 122. The leading edge 120 can be defined in the current application as approximately the most forward edge of the golf club head 100 (in the z-direction), with the hosel 110 in an upright 90 degree (perpendicular) position from a ground plane 10 (in the front-to-back, z-axis direction) as shown in FIG. 4. (The ground plane 10 is an imaginary plane located and in contact with the lowest portion of the golf club head 100, and mimics the surface of the ground upon which the golf ball would lie.) This leading edge 120 is then defined as approximately the forward most edge along the z-axis (as indicated by the axis of origin 12) generally where the striking face 112 meets the sole 102.

The trailing edge 122 is defined as approximately the most rearward edge of the sole portion 102 of the golf club head 100 (in the z-direction), again with the hosel 110 in a 90 degree (perpendicular) position from the ground plane 10 (in the front-to-back, z-axis direction), generally where the sole 102 and the back portion 114 meet.

Figure 5:
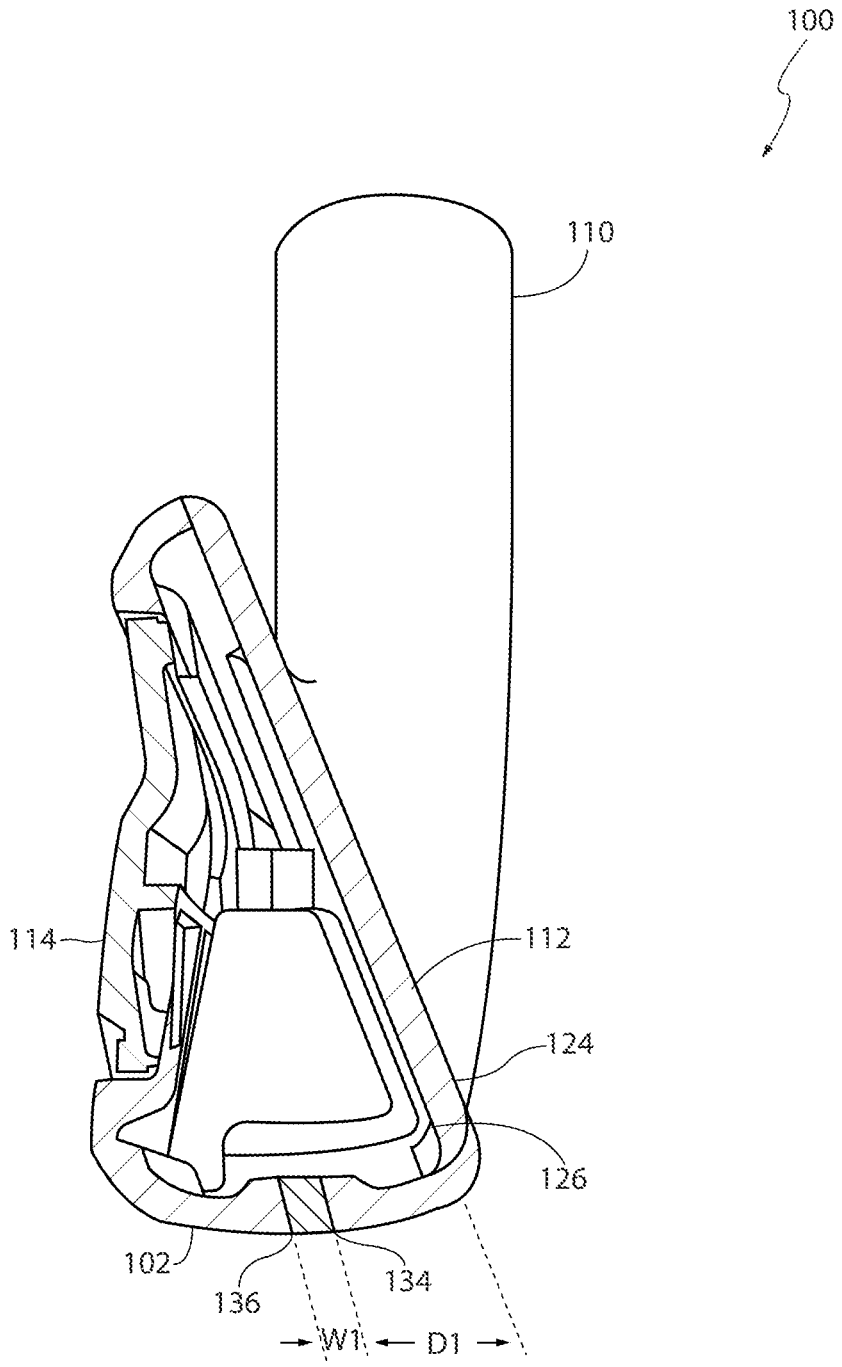
FIG. 5 of the accompanying drawings shows a cross section from a toe side view of an embodiment of the golf club head shown in FIG. 2 taken along line 5-5.

The invention of the present application incorporates a strategically positioned slot 130 on the sole 102 of the golf club head 100 to improve the performance of the golf club head 100. The slot 130 houses a weighted insert 132. Golf clubs with sole inserts typically position the inserts about the center of the sole in the z direction (front-to-back direction). In the invention of the present application, however, the slot 130 (and therefore, the weighted insert 132) is moved forward towards the striking surface 112. As shown in FIG. 5, the striking surface 112 is defined by an outer wall 124, which actually contacts the golf ball, and an inner wall 126 opposite the outer wall 124 and internal to the golf club head 100, thereby providing thickness to the striking surface 112.

The slot 130 is characterized as having a front edge 134, and back edge 136 opposite the front edge 134 and towards the back relative to the front edge 134, a proximal edge 138 adjacent the heel-side of the golf club head 100, and a distal edge 140 adjacent to the toe-side of the golf club head 100. The slot 130 has a width W1 as measured from the front edge 134 to the back edge 136 (see, FIG. 4), and a length L1 as measured from the proximal edge 138 to the distal edge 140 (see, FIG. 3). The distance D1 of the slot 130 from the striking surface 112 is determined as the shortest distance from the front edge 134 of the slot 130 to a plane defined by the inner wall 126 of the striking surface 112 (see, FIG. 5).

The distance D1 of the front edge 134 of the slot 130 to the plane of the inner wall 126 of the striking surface 112 can be about 0 mm to about 8.0 mm. A distance D1 of 0 mm means that the inner wall 126 of the striking surface 112 is in line with or can make up the front edge 134 of the slot 130. In some embodiments, the distance D1 of the front edge 134 of the slot 130 to the plane of inner wall 126 of the striking surface 112 can be less than about 6.0 mm. In some embodiments, the distance D1 of the front edge 134 of the slot 130 to the plane of the inner wall 126 of the striking surface 112 can be less than about 4.0 mm. Preferably, the distance D1 of the front edge 134 of the slot 130 to the plane of the inner wall 126 of the striking surface 112 is less than about 3.5 mm. For example, the distance D1 of the front edge 134 of the slot 130 to the plane of the inner wall 126 of the striking surface 112 can be 3.4 mm or less, 3.3 mm or less, 3.2 mm, 3.1 mm, 3.0 mm, or less. More preferably, the distance D1 of the front edge 134 of the slot 130 to the plane of the inner wall 126 of the striking surface 112 is about 2.5 mm or less. Most preferably, the distance D1 of the front edge 134 of the slot 130 to the plane of the inner wall 126 of the striking surface 112 is about 2.0 mm or less. Preferably, the distance D1 of the slot 130 to the striking surface 112 is generally a uniform distance throughout the length L1 of the slot 130.

Figure 6:
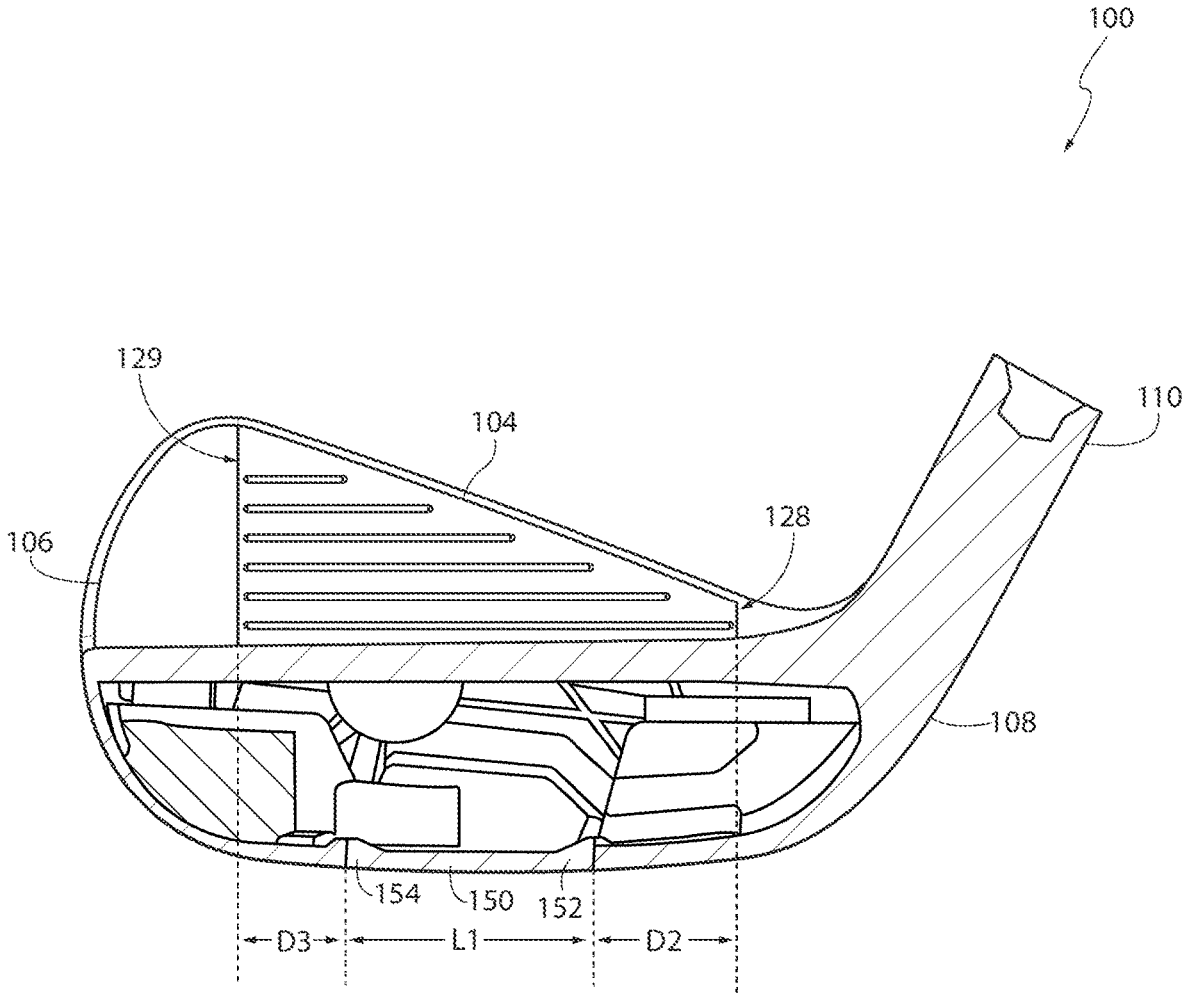
FIG. 6 of the accompanying drawings shows a cross section from a front side view of an embodiment of the golf club head shown in FIG. 3 taken along line 6-6.

As shown in FIG. 6, the slot 130 can also be characterized by its distance from the proximal end 128 (or heel end) of the striking surface 112 (which is essentially where the bottom scoreline 118 ends at the heel portion 108), and its distance from the distal end 129 (or toe side) of the striking surface 112 (which is essentially where the bottom scoreline 118 ends at the toe portion 106). The distance D2 from the slot 130 to the proximal end 128 is defined as the shortest distance from the proximal edge 138 of the slot 130 to a y-z plane defined by the proximal end 128 of the striking face 112. The distance D2 from the proximal edge 138 of the slot 130 to the y-z plane of the proximal end 128 of the striking surface 112 can be about 5 mm to about 25 mm. Preferably, the distance D2 from the proximal edge 138 of the slot 130 to the y-z plane of the proximal end 128 of the striking surface 112 can be about 10 mm to about 20 mm. More preferably, the distance D2 from the proximal edge 138 of the slot 130 to the y-z plane of the proximal end 128 of the striking surface 112 can be about 12 mm to about 16 mm.

Similarly, distance D3 from the slot 130 to the distal end 129 of the striking surface 112 is defined as the shortest distance from the distal edge 140 of the slot 130 to a y-z plane defined by the distal end 129 of the striking surface 112. The distance D3 from the distal edge 140 of the slot 130 to the y-z plane of the distal end 129 of the striking surface 112 can be about 5 mm to about 25 mm. Preferably, the distance D3 from the distal edge 140 of the slot 130 to the y-z plane of the distal end 129 of the striking surface 112 can be about 10 mm to about 20 mm. More preferably, the distance D3 from the distal edge 140 of the slot 130 to the y-z plane of the distal end 129 of the striking surface 112 can be about be about 12 mm to about 16 mm.

The slot 130 can also be characterized by its width W1 as measured from the front edge 134 to the back edge 136. The width W1 of the slot 130 can be about 1.0 mm to about 4.0 mm. Preferably, the width W1 of the slot 130 can be about 1.5 mm to about 3.5 mm. More preferably, the width W1 of the slot 130 can be about 2.0 mm to about 3.0 mm.

The slot 130 can further be characterized by its length L1 as measured from the proximal edge 138 to the distal edge 140. In the preferred embodiment, the slot 130 is generally stadium shape having a generally straight front edge 134 and a generally straight back edge 136 with a curved proximal edge 138 and a curved distal edge 140. However, the slot 130 can have other shapes, such as rectangular, oval, and other elongated shapes. The length L1 of the slot 130 can be about 20 mm to about 40 mm. Preferably, the length L1 of the slot 130 can be about 25 mm to about 35 mm. More preferably, the length L1 of the slot 130 can be about 27 mm to about 32 mm.

The insert 132 is shaped and dimensioned to fit inside the slot 130, and can be characterized by its shape. From a bottom plan view as shown in FIG. 3, the insert 132 can be generally stadium or pill shaped having elongated sides and curved ends, like the slot 130, although other shapes can also be used, such as rectangle, oval, and the like. From a front side elevation view as shown in FIG. 6, the insert 132 can be comprised of a main body 150 portion terminating at opposing proximal end portion 152 and distal end portion 154. The length L2 of the insert 132 is measured from the proximal end portion 152 to the distal end portion 154, and the height H1 of the insert 132 is measured from a bottom surface of the insert 132 to a top surface of the insert 132.

In some embodiments the height of the insert H1 as measured from a bottom surface to a top surface can be uniform throughout the entire length L2 of the insert 132. As such, inserts 132 with a uniform height H1 can range from about 1 mm to about 5 mm. Preferably, the height H1 of the insert 132 is less than about 5 mm. More preferably, the height H1 of the insert 132 is less than about 4 mm. Most preferably, the height H1 of the insert 132 is less than about 3 mm.

In the preferred embodiment, the insert 132 can have a non-uniform height H1. For example, the proximal end portion 152 and distal end portion 154 of the insert 132 can be raised relative to the main body 150 so that the height H1 of the body 150, which makes up a central portion of the insert 132 is less than the heights H2, H3 of the proximal and distal end portions 152, 154. As such, as the insert 132 progresses from the central portion of the body 150 towards the proximal end portion 152 and the distal end portion 154, the height of the insert 132 can gradually increase, remain flat then gradually increase after a specific point, or remain flat and abruptly increase (step up) at the proximal end portion 152 and distal end portion 154. In some embodiments, the central portion may be recessed, thereby creating a narrow channel in the central portion surrounded by a raised rim (see, e.g., FIG. 11).

For inserts 132 with non-uniform height, the height H1 of the body 150 of the insert 132 can be about 1.0 mm to about 2.5 mm. Preferably, the height H1 of the body 150 of the insert 132 can be about 1.3 mm to about 2.3 mm. More preferably, the height H1 of the body 150 of the insert 132 can be about 1.6 mm to about 2.0 mm. The heights H1, H2 at the proximal end portion 152, the distal end portion 154, or a perimeter rim surrounding the body 150, can each be about 2.0 mm to about 4.0 mm. Preferably, the heights H1, 112 at the proximal end portion 152 and distal end portions 154 can each be about 2.5 mm to about 3.5 mm. More preferably, the heights H1, H2 at the proximal end portion 152 and distal end portions 154 can each be about 2.8 mm to about 3.2 mm.

The overall length L2 of the insert 132 as measured from the proximal end portion 152 to the distal end portion 154 is substantially similar to the length L1 of the slot 130. As such, the overall length L2 of the insert 132 can be about 20 mm to about 40 mm. Preferably, the overall length L2 of the insert 132 can be about 25 mm to about 35 mm. More preferably, the overall length L2 of the insert 132 can be about 27 mm to about 32 mm.

The length L3 of the main body portion 150 of the insert 132 (e.g., the uniformly flat portion of the insert 132 in between the proximal end portion 152 and distal end portion 154 as shown in FIG. 6) can be about 13 mm to about 25 mm. Preferably, the length L3 of the main body portion 150 of the insert 132 can be about 15 mm to about 23 mm. More preferably, the length L3 of the main body portion 150 of the insert 132 can be about 17 mm to about 21 mm.

Figure 7:
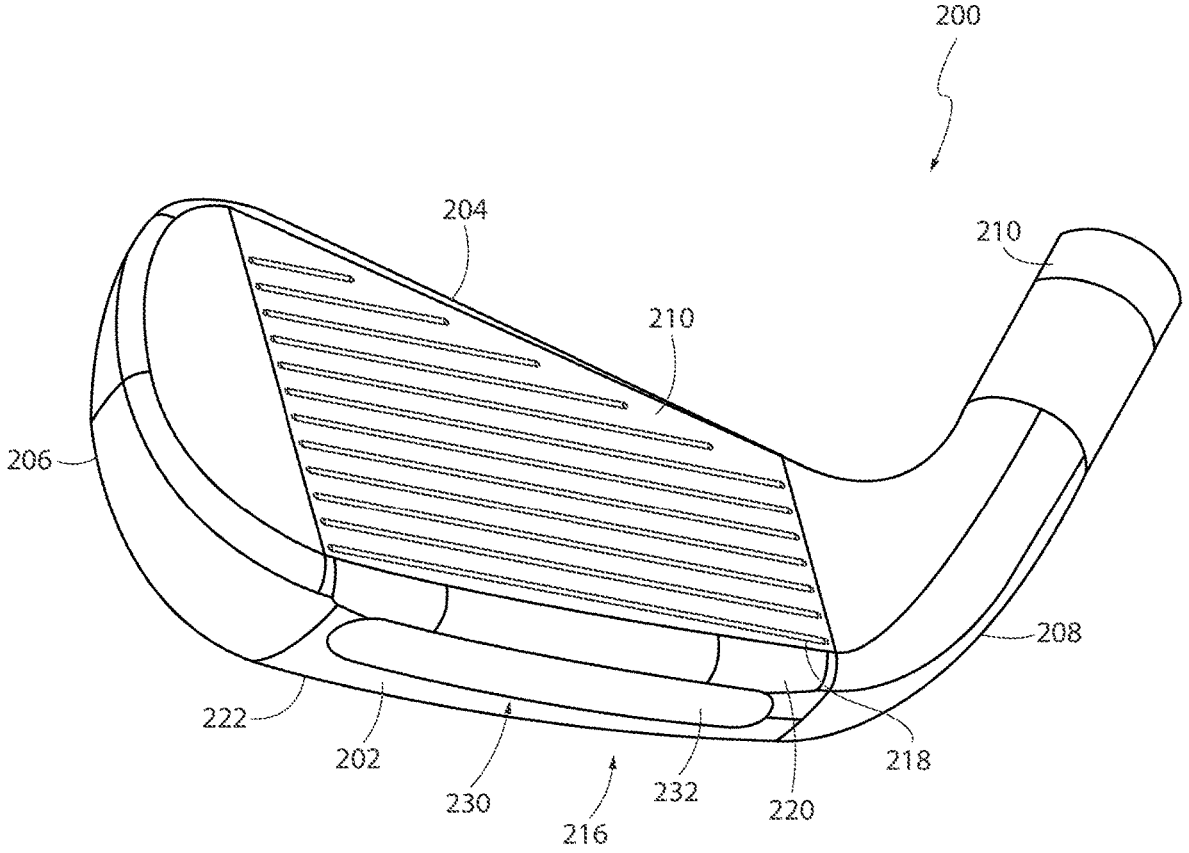
FIG. 7 of the accompanying drawings shows a perspective view of another embodiment of a golf club head in accordance with an exemplary embodiment of the present invention.
Figure 8:
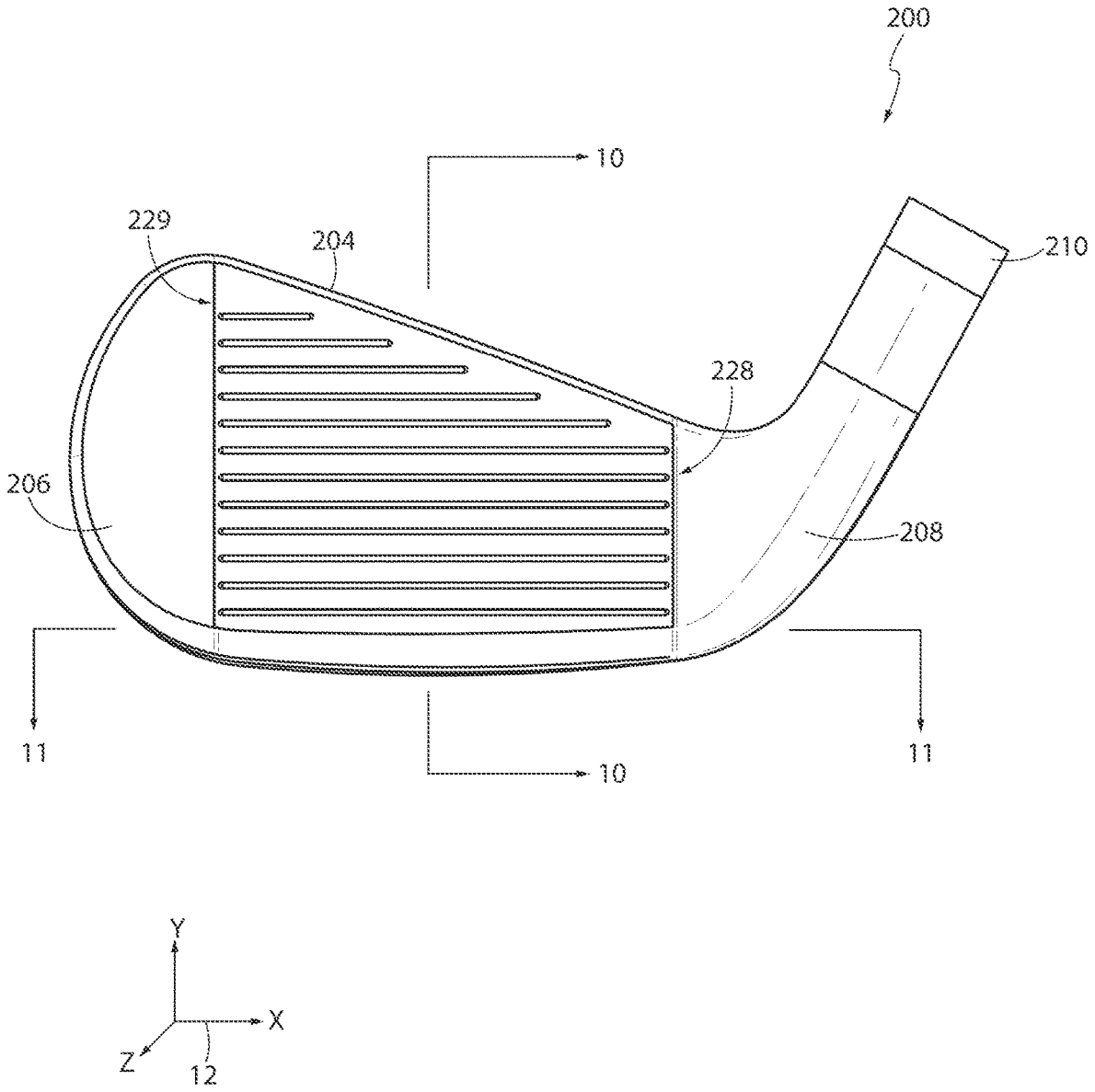
FIG. 8 of the accompanying drawings shows a front elevation view of an embodiment of the golf club head shown in FIG. 7.
Figure 9:
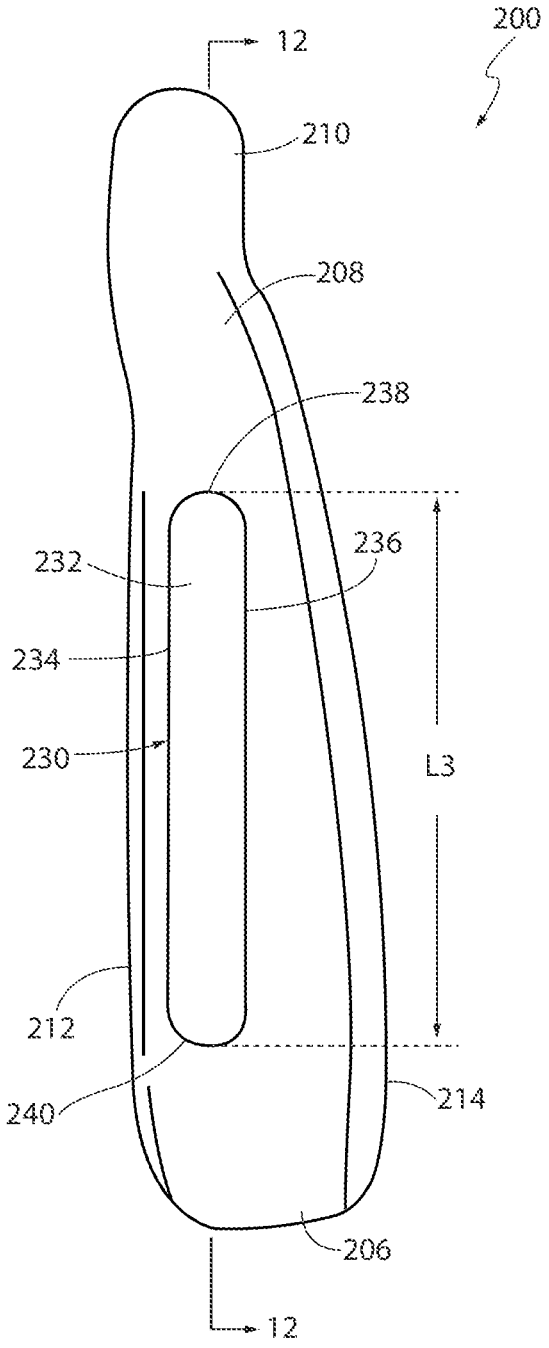
FIG. 9 of the accompanying drawings shows a bottom plan view of an embodiment of the golf club head shown in FIG. 7.

With reference to FIGS. 7-12, in another embodiment of the present invention, the golf club head 200 can have the same general configuration as the golf club head 100 shown in the embodiments of FIGS. 1-6. As such, the golf club head 200, as shown in FIGS. 7-9, can generally have a sole 202; a topline 204 opposite the sole 202; a toe portion 206 adjacent to the sole 202 and the topline 204; a heel portion 208 opposite the toe portion 206 and adjacent to the sole 202 and the topline 204; a striking face 212 adjacent to the sole 202, topline 204, toe portion 206, and heel portion 208; a back portion 214 opposite the striking face 212 and adjacent to the sole 202, topline 204, toe portion 206, and heel portion 208; and a hosel 210 adjacent to the heel portion 208 and topline 204. The hosel 210 defines a longitudinal shaft axis A2 and is configured to receive a shaft. The striking face 212 can further be characterized with a plurality of horizontal scorelines 218.

The striking face portion 212 is located at a frontal portion of the golf club head 200. As a result, the back portion 214 is located opposite the striking face portion 212; the topline 204 is located at an upper portion of the golf club head 200; the heel portion 208 is located at a proximal end of the golf club head 200; the toe portion 206 is located at a distal end of the golf club head 200 opposite the heel portion 208; and the sole 202 is located at a lower portion of the golf club head 200 opposite the topline 204. An axis of origin 12 is provided (for reference only for ease and clarity of description) indicating the x-y-z direction relative to the golf club head 200 in the examples provided.

Figure 10:
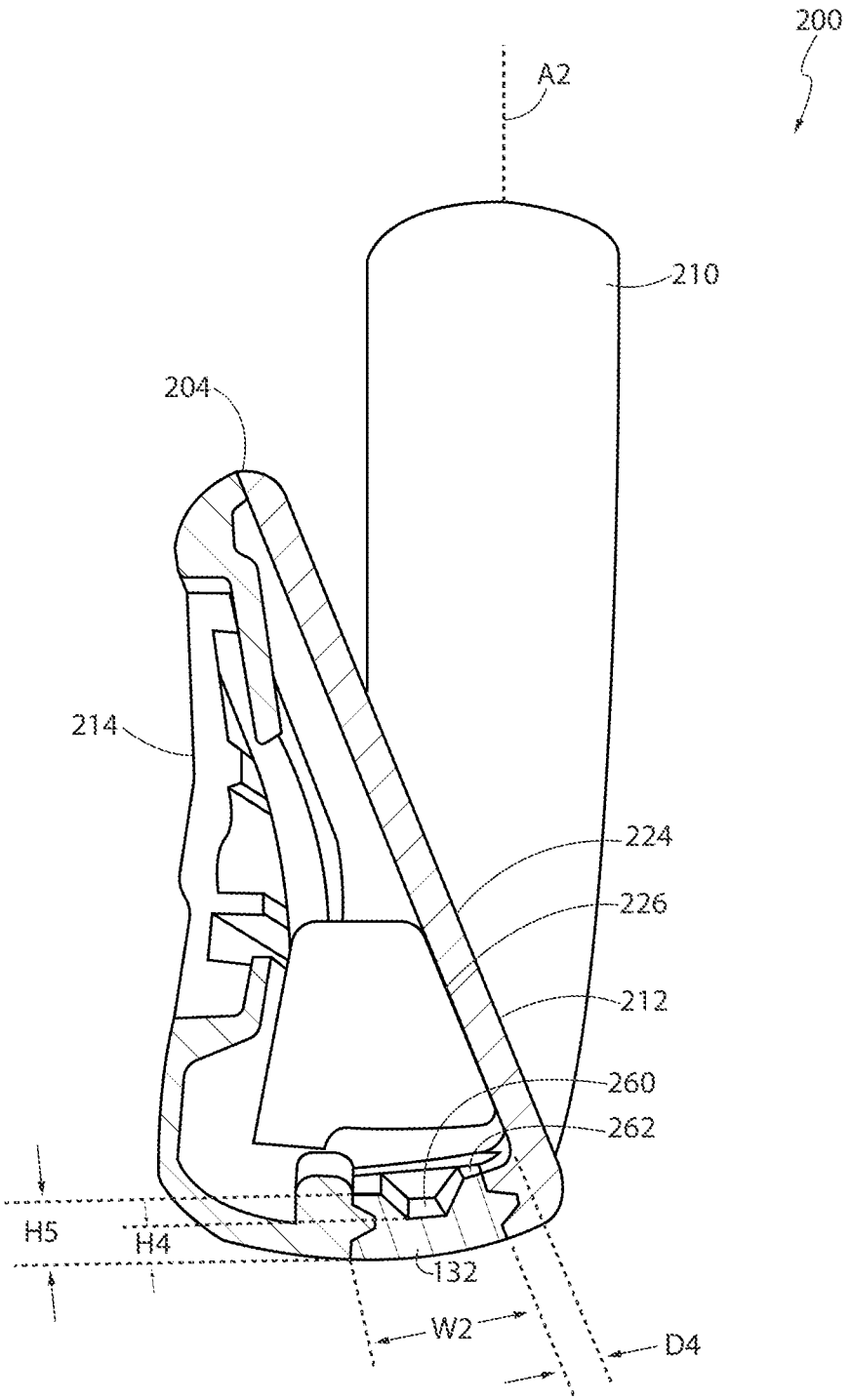
FIG. 10 of the accompanying drawings shows a cross section from a toe side view of an embodiment of the golf club head shown in FIG. 8 taken along line 10-10.

The golf club head 200 further comprises a leading edge 220 located approximately where the striking face 212 meets the sole 202; a trailing edge 222 adjacent to the back portion 214 and the sole 202; and the sole 202 in between the leading edge 220 and the trailing edge 222. The leading edge 220 can be defined in the current application as approximately the most forward edge of the golf club head 200 (in the z-direction), with the hosel 210 in an upright 90 degree (perpendicular) position from a ground plane 10 (in the front-to-back, z-axis direction) as shown in FIG. 10. This leading edge 220 is then defined as approximately the forward most edge along the z-axis (as indicated by the axis of origin 12) generally where the striking face 212 meets the sole 202.

The trailing edge 222 can be defined as approximately the most rearward edge of the sole portion 202 of the golf club head 200 (in the z-direction), again with the hosel 210 in a 90 degree (perpendicular) position from the ground plane 10 (in the front-to-back, z-axis direction), generally where the sole portion 202 and the back portion 214 meet.

The invention of the present application incorporates a strategically positioned slot 230 on the sole 202 of the golf club 200 head to improve the performance of the golf club head 200. The slot 230 houses a weighted insert 232. In the invention of the present application, however, the slot 230 (and therefore, the weighted insert 232) is moved forward towards the striking surface 212 compared to traditional golf clubs with inserts. As shown in FIG. 10, the striking surface 212 is defined by an outer wall 224, which actually contacts the golf ball, and an inner wall 226 behind the outer wall 224 and internal to the golf club head 200, thereby providing thickness to the striking surface 212.

As shown in FIG. 9, the slot 230 is characterized as having a front edge 234, back edge 236 opposite the front edge 234 and towards the back relative to the front edge 234, a proximal edge 238 adjacent the heel-side of the golf club head 200, and a distal edge 240 adjacent to the toe-side of the golf club head 200. The slot 230 has a width W2 as measured from the front edge 234 to the back edge 236, and a length L4 as measured from the proximal edge 238 to the distal edge 240. The distance D4 of the slot 230 from the striking surface 212 is determined as the shortest distance from the front edge 234 of the slot 230 to a plane defined by the inner wall 226 of the striking surface 212.

As shown in FIG. 10, the distance D4 of the front edge 234 of the slot 230 to a plane defined by the inner wall 226 of the striking surface 212 can be about 0 mm to about 8.0 mm. A distance D4 of 0 mm means that the inner wall 226 of the striking surface 212 is in line with or makes up the front edge 234 of the slot 230. In some embodiments, the distance D4 of the front edge 234 of the slot 230 to the plane of the inner wall 226 of the striking surface 212 can be less than about 6.0 mm. In some embodiments, the distance D4 of the front edge 234 of the slot 230 to the plane of the inner wall 226 of the striking surface 212 can be less than about 4.0 mm. Preferably, the distance D4 of the front edge 234 of the slot 230 to the plane of the inner wall 226 of the striking surface 212 is less than about 3.5 mm. For example, the distance D4 of the front edge 234 of the slot 230 to the plane of the inner wall 226 of the striking surface 212 can be about 3.4 mm, 3.3 mm, 3.2 mm, or less. More preferably, the distance D4 of the front edge 234 of the slot 230 to the plane of the inner wall 226 of the striking surface 212 can be about 2.5 mm or less. Most preferably, the distance D4 of the front edge 234 of the slot 230 to the plane of the inner wall 226 of the striking surface 212 can be about 2.0 mm or less. Preferably, the distance D4 of the slot 230 to the striking surface 212 is generally a uniform distance throughout the length L4 of the slot 230.

Figure 11:
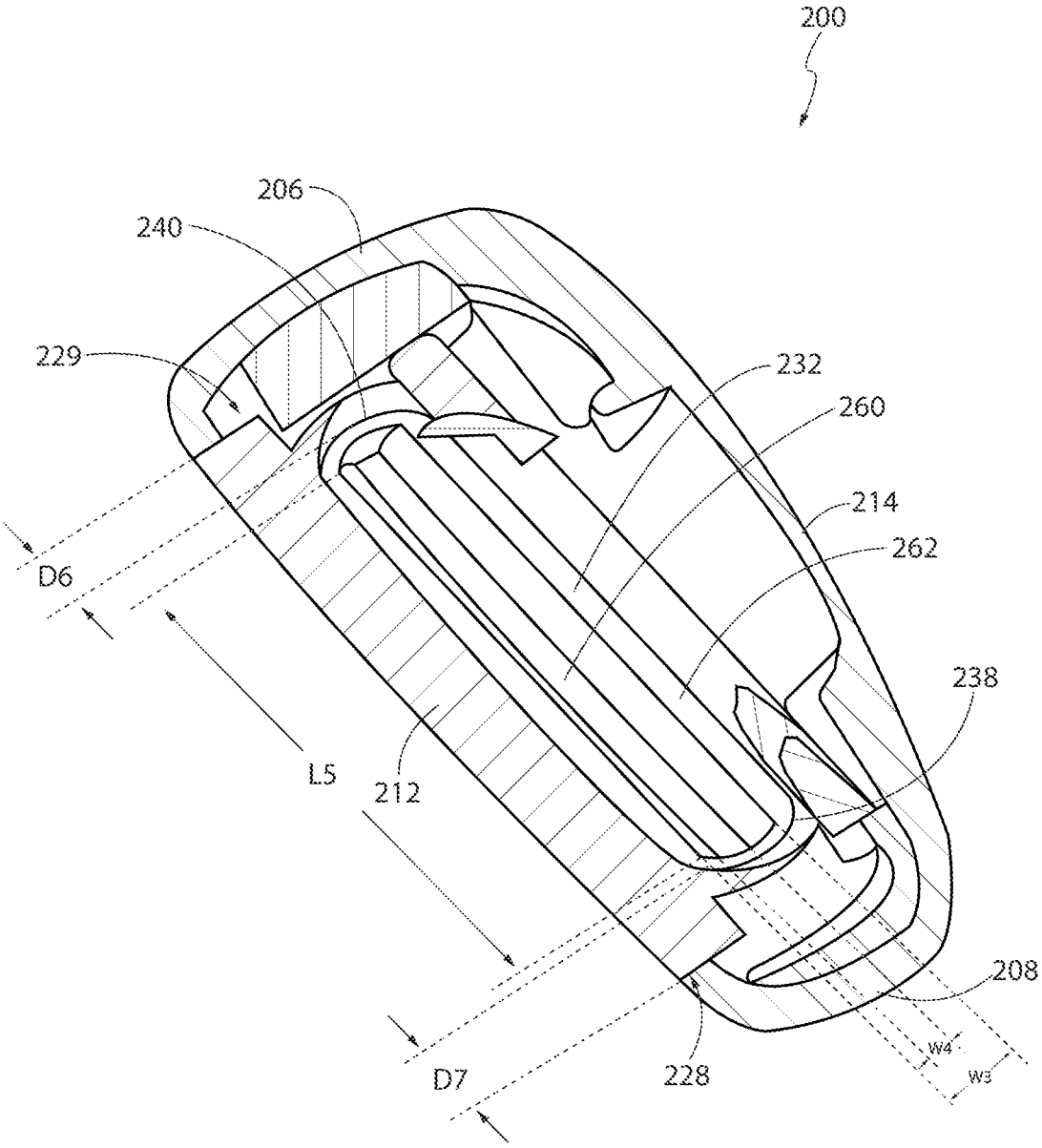
FIG. 11 of the accompanying drawings shows a cross section from a top plan view of an embodiment of the golf club head shown in FIG. 8 taken along line 11-11.
Figure 12:
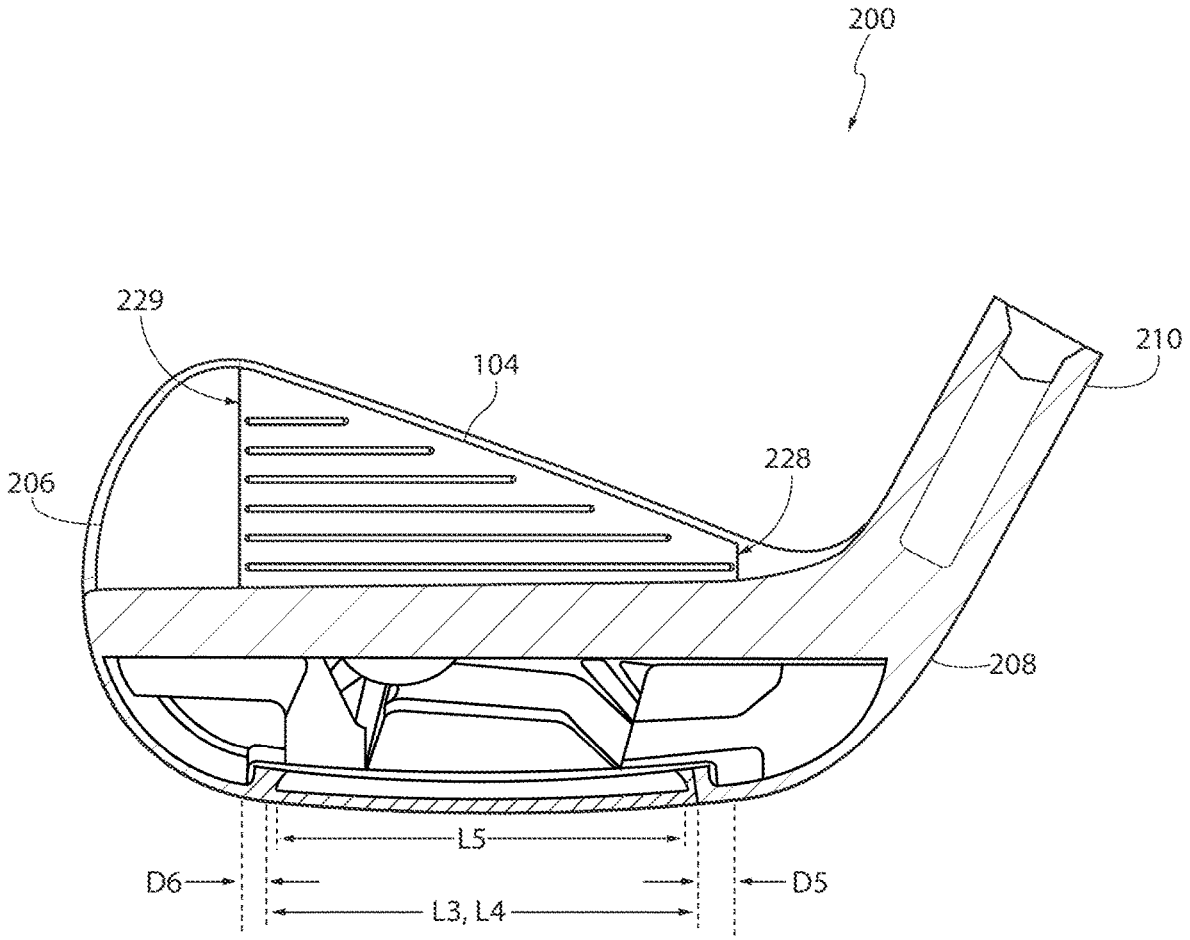
FIG. 12 of the accompanying drawings shows a cross section from a front elevation view of an embodiment of the golf club head shown in FIG. 9 taken along line 12-12.

As shown in FIG. 11, the slot 230 can also be characterized its distance from the proximal end 228 (or heel end) of the striking surface 212 (which is essentially where the bottom scoreline 218 ends at the heel portion 208), and its distance from the distal end 229 (or toe side) of the striking surface 212 (which is essentially where the bottom scoreline 218 ends at the toe portion 206). The distance D5 of the slot 230 to the proximal end 228 is defined as the shortest distance from the proximal edge 238 to a y-z plane defined by the proximal end 228 of the striking surface 212. The distance D5 from the proximal edge 238 of the slot 230 to the y-z plane defined by the proximal end 228 of the striking surface 212 can be about 3.4 mm to about 4.6 mm. Preferably, the distance D5 from the proximal edge 238 of the slot 230 to the y-z plane defined by the proximal end 228 of the striking surface 212 can be about 3.6 mm to about 4.4 mm.

More preferably, the distance D5 from the proximal edge 238 of the slot 230 to the y-z plane defined by the proximal end 228 of the striking surface 212 can be about 3.8 mm to about 4.2 mm.

Similarly, the distance D6 of the slot 230 to the distal end 229 is defined as the shortest distance from the distal edge 240 of the slot 230 to a y-z plane defined by the distal end 229 of the striking surface 212. The distance D6 from the distal edge 240 of the slot 230 to the y-z plane of the distal end 229 of the striking surface 212 can be about 3.4 mm to about 4.6 mm. Preferably, the distance D6 from the distal edge 240 of the slot 230 to the y-z plane of the distal end 229 of the striking surface 212 can be about 3.6 mm to about 4.4 mm. More preferably, the distance D6 from the distal edge 240 of the slot 230 to the y-z plane of the distal end 229 of the striking surface 212 can be about 3.8 mm to about 4.2 mm.

The slot 230 can also be characterized by its width W2 as measured from the front edge 234 to the back edge 236. The width W2 of the slot 230 can be about 4.0 mm to about 13.0 mm. Preferably, the width W2 of the slot 230 can be about 6.0 mm to about 11.0 mm. More preferably, the width W2 of the slot 230 can be about 8.0 mm to about 9.0 mm.

The slot 230 can further be characterized by its length L4 as measured from the proximal edge 238 to the distal edge 240. In the preferred embodiment, the slot 230 is generally stadium shape having a generally straight front edge 234 and a generally straight back edge 236 with a curved proximal edge 238 and a curved distal edge 240. However, the slot 230 can have other shapes, such as rectangular, oval, and other elongated shapes. The length L4 of the slot 230 can be about 40 mm to about 55 mm. Preferably, the length L4 of the slot 230 can be about 43 mm to about 52 mm. More preferably, the length L4 of the slot 230 can be about 46 mm to about 50 mm.

The insert 232 is shaped and dimensioned to fit inside the slot 230, and can be characterized by its shape. From a bottom plan view as shown in FIG. 9, the insert 232 can be generally stadium or pill shaped having straight, elongated sides and curved ends, like the slot 230, although other shapes can also be used, such as rectangle, oval, and the like. In some embodiments, the insert 132 can have a uniform height as measured from a bottom surface of the insert 232 to a top surface of the insert 232. In the preferred embodiment, as shown in FIGS. 10 and 11, the insert 232 can have a non-uniform height. In other words, different portions of the insert 232 can have different heights. For example, the terminal ends of the insert 132 can have a greater height than a central portion 260 of the insert 232. In some embodiments, the central portion 260 of the insert 132 can be recessed. A recessed central portion 260 results in a height 114 of the recessed central portion 260 of the insert 232 to be smaller than a height 115 of an outer rim portion 262 of the insert 232. The central recessed portion 260 is not required to be centered within the insert 232, rather it refers to being located towards the center area relative to the perimeter edges of the insert 232.

As such, the insert 232 of the preferred embodiment can have two heights, a first height 114 as measured from the bottom of the insert 232 to the recessed central portion 260 (i.e. the thickness of the recessed central portion 260), and a second height 115 of the insert 232 as measured from the bottom of the insert 232 to the top of the rim 262 of the insert 232. The height 114 of the recessed central portion 26 can be about 1.0 mm to about 2.5 mm. Preferably, the height 114 of the recessed central portion 260 of the insert 132 can be about 1.3 mm to about 2.3 mm. More preferably, the height 114 of the recessed central portion 260 of the insert 132 can be about 1.6 mm to about 2.0 mm. The height 115 of the rim 262 of the insert 232 can be about 2.0 mm to about 4.0 mm. Preferably, the height 115 of the rim 262 can be about 2.5 mm to about 3.5 mm. More preferably, the height 115 of the rim 262 can be about 2.8 mm to about 3.2 mm.

The overall length L5 of the insert 232 is substantially similar to the length L4 of the slot 230 into which the insert 232 is to be inserted. As such, the overall length L5 of the insert 232 can be about 40 mm to about 55 mm. Preferably, the overall length L5 of the insert 232 can be about 43 mm to about 52 mm. More preferably, the overall length L5 of the insert 232 can be about 46 mm to about 50 mm.

The length L6 of the recessed central portion 260 of the insert 232 can be about 39 mm to about 51 mm. Preferably, the length L6 of the recessed central portion 260 of the insert 232 can be about 41 mm to about 49 mm. More preferably, the length L6 of the recessed central portion 260 of the insert 232 can be about 43 mm to about 47 mm. The wall surrounding the recessed portion can be a vertical wall, a ramped wall, a curved wall, a stepped wall, and the like, as the wall descends from the rim 262 to the recessed central portion 260. As such, the width W3 as measured from the inner edge of the rim 262 can be larger than the width W4 of the recessed central portion 260. For example, the width W3 of the inner edge of the rim 262 can be about 3.0 mm to about 6.0 mm. Preferably, the width W3 of the inner edge of the rim 262 can be about 3.5 mm to about 5.5 mm. More preferably, the width W3 of the inner edge of the rim 262 can be about 4.0 mm to about 5.0 mm. The width W4 of the recessed central portion 260 of the insert 232 can be about 1.0 mm to about 3.0 mm. Preferably, the width W4 of the recessed central portion 260 of the insert 232 can be about 1.5 mm to about 2.5 mm. More preferably, the width W4 of the recessed central portion 260 of the insert 232 can be about 1.8 mm to about 2.2 mm.

In any of the embodiments disclosed herein, it may be desirable to facilitate fixture of the insert inside its respective slot. For example, as shown in FIG. 10, the insert 232 may comprise a protrusion 264. In the embodiment shown in FIG. 10, the protrusion 264 is a forward protrusion (toward the striking face 212) from the front side of the insert 232. However, the protrusion 264 can also be a rearward protrusion (towards the back portion 214) from the back side of the insert 232, a lateral protrusion (towards the heel 208 or the toe 206) from the toe side or heel side of the insert 232, or any combination thereof. Alternatively, the insert 232 can have an indentation 266 on the front, back or sides, or any combination thereof. By way of example only, FIG. 10 shows a forward protrusion 264 on the front side of the insert 232 with a rear indentation 266 on the back side of the insert 232. Where there is a protrusion 264 or indentation 266 on the insert 232, there can be a corresponding protrusion or indentation in the slot 230 to mate with the insert 232. Although the protrusion 264 and indentation 266 have been disclosed with the present embodiment, the concept can be applied to any embodiment disclosed herein.

Figure 13:
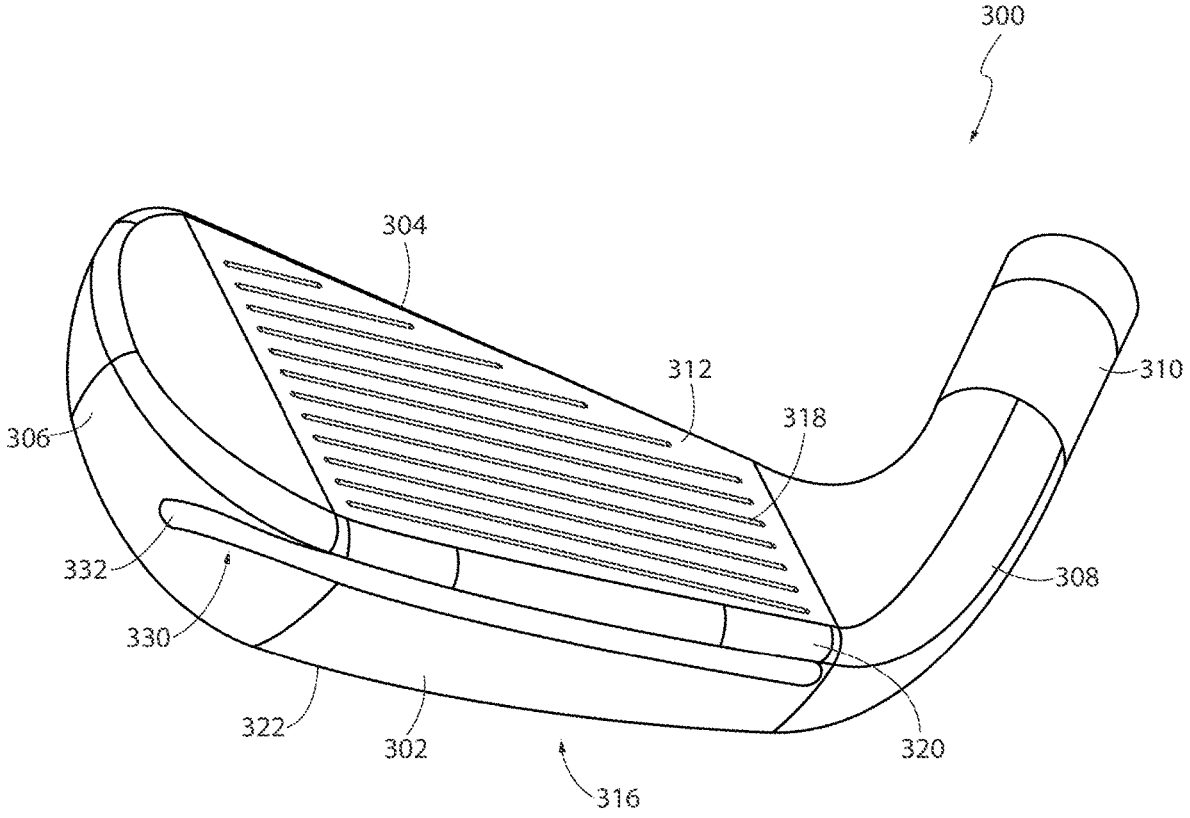
FIG. 13 of the accompanying drawings shows a perspective view of another embodiment of a golf club head in accordance with an exemplary embodiment of the present invention.
Figure 14:
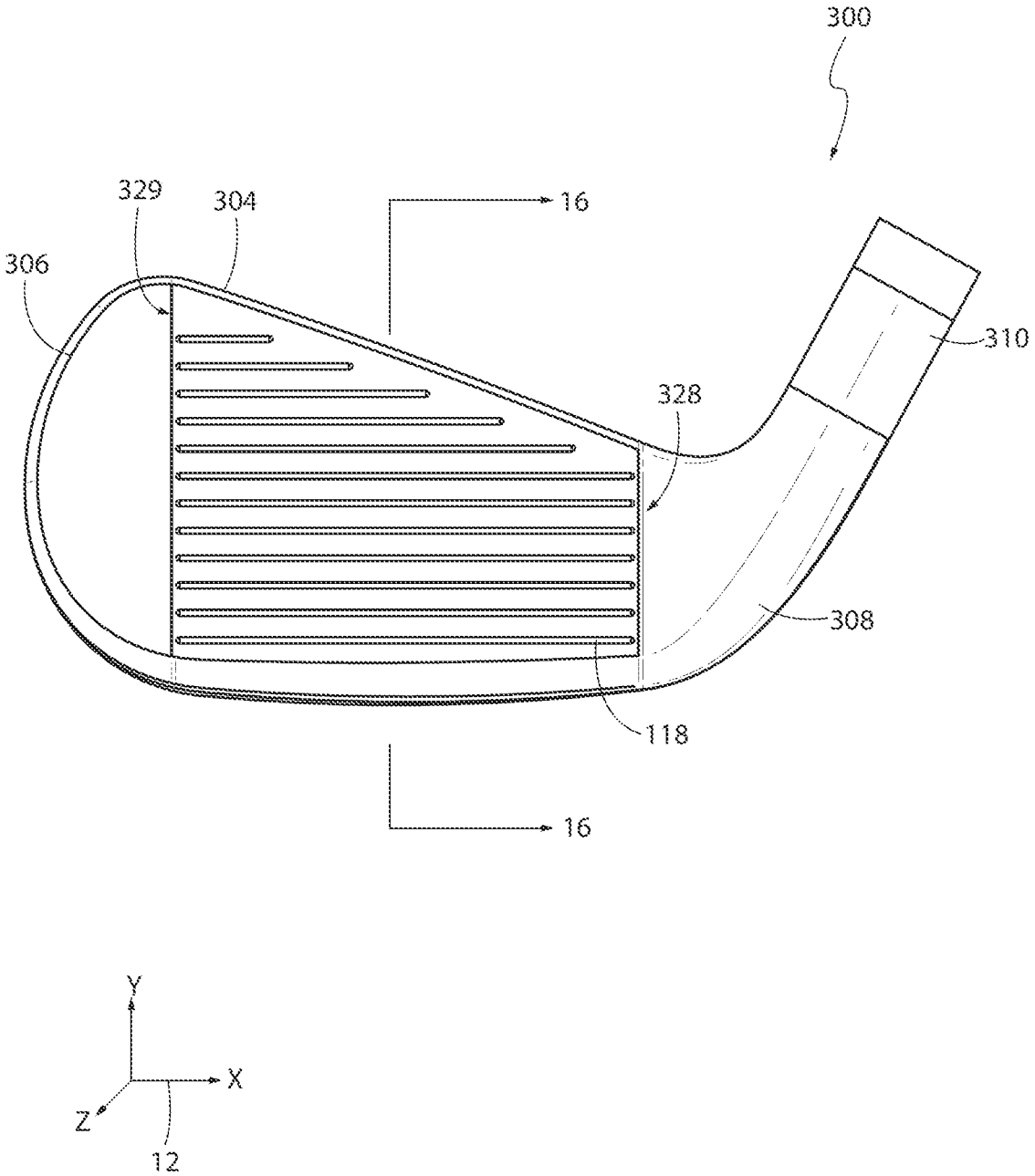
FIG. 14 of the accompanying drawings shows a front elevation view of an embodiment of the golf club head shown in FIG. 13.
Figure 15:
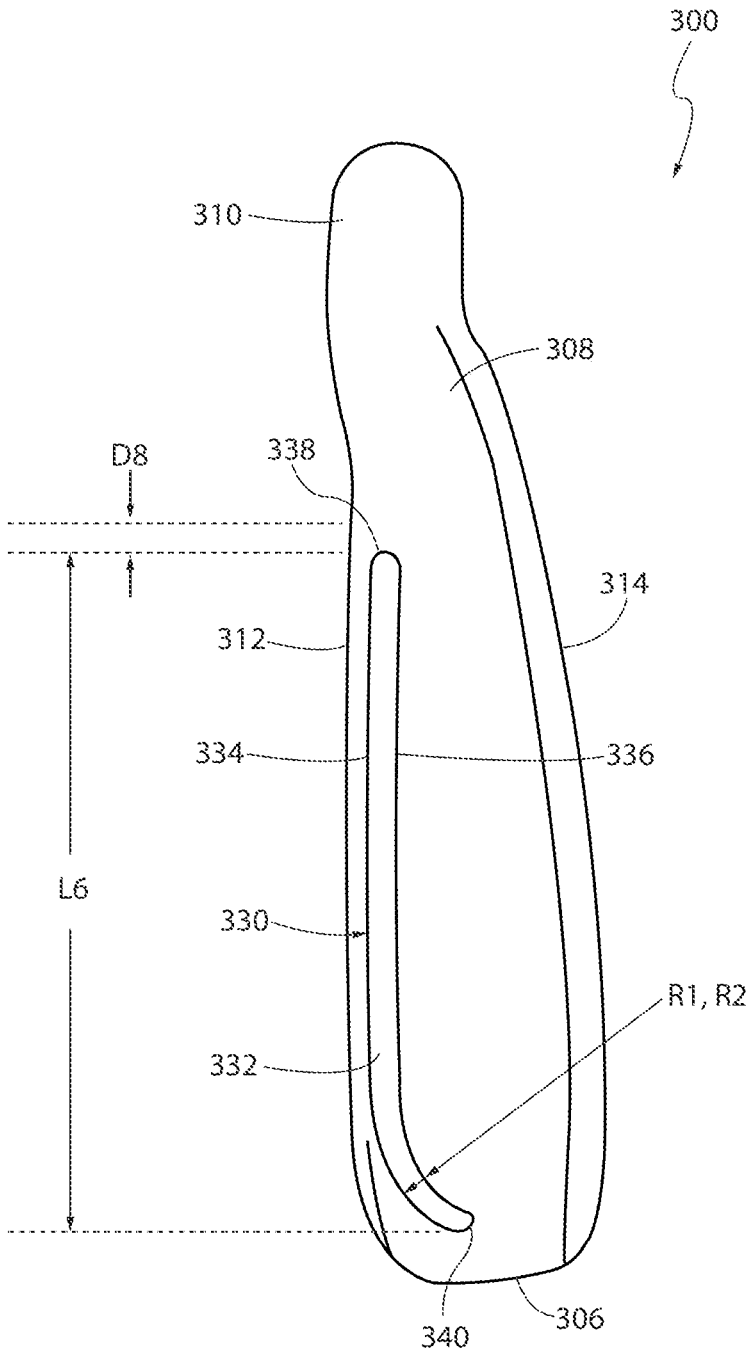
FIG. 15 of the accompanying drawings shows a bottom plan view of an embodiment of the golf club head shown in FIG. 13.

With reference to FIGS. 13-17, in another embodiment of the present invention, the golf club head 300 can have the same general configuration as the golf club heads 100, 200 shown in the embodiments of FIGS. 1-12. As such, the golf club head 200, as shown in FIGS. 13-15, can generally have a sole 302; a topline 304 opposite the sole 302; a toe portion 306 adjacent to the sole 302 and the topline 304; a heel portion 308 opposite the toe portion 306 and adjacent to the sole 302 and the topline 304; a striking face 312 adjacent to the sole 302, topline 304, toe portion 306, and heel portion 308; a back portion 314 opposite the striking face 312 and adjacent to the sole 302, topline 304, toe portion 306, and heel portion 308; and a hosel 310 adjacent to the heel portion 308 and topline 304. The hosel 310 defines a longitudinal shaft axis A3 and is configured to receive a shaft. The striking face 312 can further be characterized with a plurality of horizontal scorelines 318.

The striking face portion 312 is located at a frontal portion of the golf club head 300. As a result, the back portion 314 is located opposite the striking face portion 312; the topline 304 is located at an upper portion of the golf club head 300; the heel portion 308 is located at a proximal end of the golf club head 300; the toe portion 306 is located at a distal end of the golf club head 300 opposite the heel portion 308; and the sole 302 is located at a lower portion of the golf club head 300 opposite the topline 304. An axis of origin 12 is provided (for reference only for ease and clarity of description) indicating the x-y-z direction relative to the golf club head 300 in the examples provided.

Figure 16:
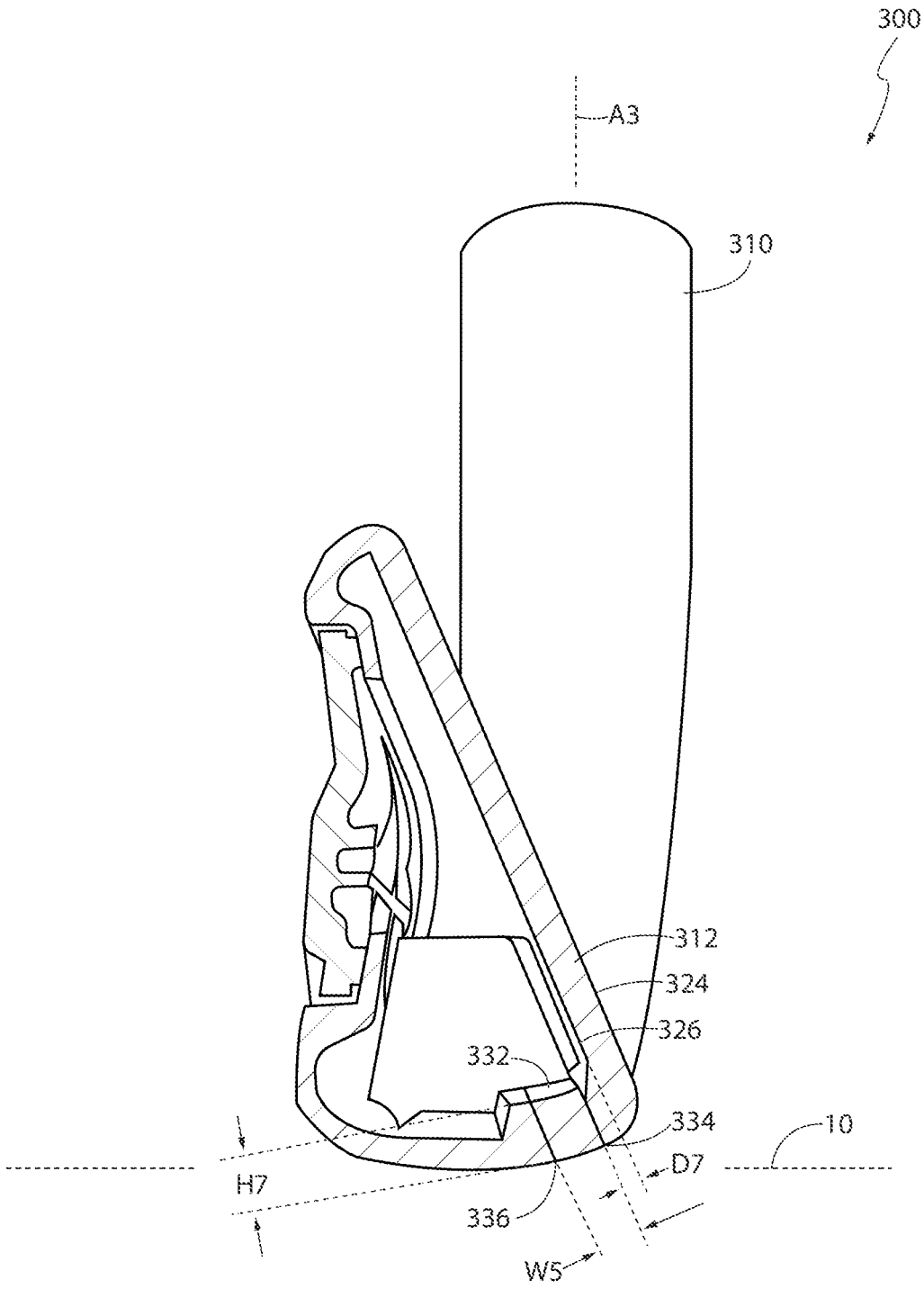
FIG. 16 of the accompanying drawings shows a cross section from a toe side view of an embodiment of the golf club head shown in FIG. 14 taken along line 16-16.
Figure 17:
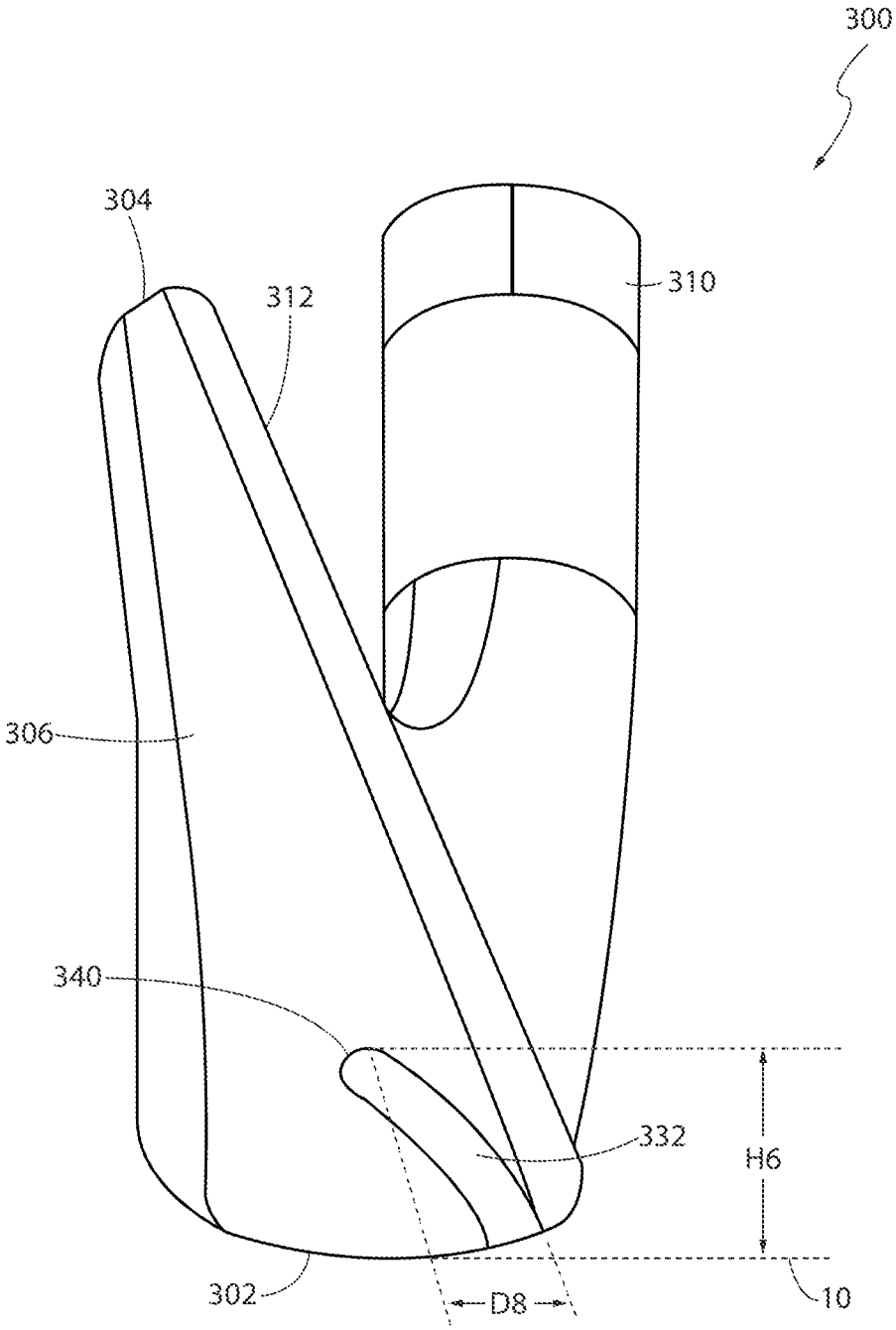
FIG. 17 of the accompanying drawings shows an elevation view from the toe side of an embodiment of the golf club head shown in FIG. 13.

The golf club head 300 further comprises a leading edge 320 located approximately where the striking face 312 meets the sole 302; a trailing edge 322 adjacent to the back portion 314 and the sole 302; and the sole 302 in between the leading edge 320 and the trailing edge 322. The leading edge 320 can be defined in the current application as approximately the most forward edge of the golf club head 300, with the hosel 310 in an upright 90 degree (perpendicular) position from a ground plane 10 (in the front-to-back, z-axis direction) as shown in FIG. 16. This leading edge 320 is then defined as approximately the forward most edge along the z-axis (as indicated by the axis of origin 12) generally where the striking face 312 meets the sole 302.

The trailing edge 322, which is defined as approximately the most rearward edge of the sole portion 302 of the golf club head 300 (in the z-direction), again with the hosel 310 in a 90 degree (perpendicular) position from the ground plane 10 (in the front-to-back, z-axis direction), is generally where the sole portion 302 and the back portion 314 meet.

The invention of the present application incorporates a strategically positioned slot 330 on the sole 302 of the golf club 300 head to improve the performance of the golf club head 300. The slot 330 houses a weighted insert 332. In the invention of the present application, the slot 330 (and therefore, the weighted insert 332) is moved forward towards the striking surface 212 compared to traditional golf clubs with inserts. As shown in FIG. 16, the striking surface 312 is defined by an outer wall 324, which actually contacts the golf ball, and an inner wall 326 behind the outer wall 324 and internal to the golf club head 300, thereby providing thickness to the striking surface 312.

As shown in FIG. 15, the slot 330 is characterized as having a front edge 334, a back edge 336 opposite the front edge 334 and towards the back relative to the front edge 334, a proximal edge 338 adjacent the heel-side of the golf club head 300, and a distal edge 340 adjacent to the toe-side of the golf club head 300. The slot 330 has a width W5 as measured from the front edge 334 to the back edge 336, and a length L7 as measured from the proximal edge 238 to the distal edge 240. The distance D7 of the slot 330 from the striking surface 312 is determined as the shortest distance from the front edge 334 of the slot 330 to a plane defined by the inner wall 326 of the striking surface 312.

As shown in FIG. 16, the distance D7 of the front edge 334 of the slot 330 to the plane of the inner wall 326 of the striking surface 312 can be about 0 mm to about 8.0 mm. A distance D7 of 0 mm means that the inner wall 326 of the striking surface 312 is in line with or makes up the front edge 334 of the slot 330. In some embodiments, the distance D7 of the front edge 334 of the slot 330 to the plane of the inner wall 326 of the striking surface 312 can be less than about 6.0 mm. In some embodiments, the distance D7 of the front edge 334 of the slot 330 to the plane of the inner wall 326 of the striking surface 312 can be less than about 4.0 mm. Preferably, the distance D7 of the front edge 334 of the slot 330 to the plane of the inner wall 326 of the striking surface 312 can be less than about 3.5 mm. For example, the distance D7 of the front edge 334 of the slot 330 to the plane of the inner wall 326 of the striking surface 312 can be 3.4 mm, 3.3 mm, 3.2 mm, or less. More preferably, preferably, the distance D7 of the front edge 334 of the slot 330 to the plane of the inner wall 326 of the striking surface 312 can be about 2.5 mm or less. Most preferably, the distance D7 of the front edge 334 of the slot 330 to the plane of the inner wall 326 of the striking surface 312 can be about 2.0 mm or less. In some embodiments, the distance D7 of the slot 230 to the striking surface 212 is generally a uniform distance throughout the length L7 of the slot 230.

The slot 330 can also be characterized by its distance from the proximal end 328 (or heel end) of the striking surface 312 (which is essentially where the bottom scoreline 318 ends at the heel portion 208). The distance D8 from the slot 330 to the proximal end 328 of the striking surface 312 is defined as the shortest distance from the proximal edge 338 of the slot 330 to a y-z plane defined by the proximal end 328 of the striking surface 312. The distance D8 from the proximal edge 338 of the slot 330 to the y-z plane of the proximal end 328 of the striking surface 312 can be about 0 mm to about 1.5 mm. Preferably, the distance D8 from the proximal edge 338 of the slot 330 to the proximal end 328 of the y-z plane of the striking surface 312 can be about 0.15 mm to about 1.2 mm. More preferably, the distance D8 from the proximal edge 338 of the slot 330 to the y-z plane of the proximal end 328 of the striking surface 312 can be about 0.3 mm to about 0.9 mm.

In some embodiments, however, the proximal edge 338 of the slot 330 can extend past the proximal end 328 of the striking surface 312 further towards or into the heel portion 308. For example, the proximal edge 338 can extend up to 10 mm past the proximal end 328 of the striking surface 312. Preferably, the proximal edge 338 can extend up to 8 mm past the proximal end 328 of the striking surface 312. More preferably, the proximal edge 338 can extend up to 5 mm past the proximal end 328 of the striking surface 312.

With respect to the distal edge 340 of the slot 330, in the preferred embodiment, the distal edge 340 can continue past the distal end 329 of the striking surface 312 up into the toe portion 306. The distal edge 340 can rise up into the toe portion 306 up to a height 116 of about 50 mm above the sole 302 (or ground plane 10). Preferably, the distal edge 340 can rise up into the toe portion 306 up to a height 116 of about 40 mm above the sole 302. More preferably, the distal edge 340 can rise up into the toe portion 306 up to a height 116 of about 30 mm above the sole 302.

In general, the slot 330 maintains a uniform distance from the striking face 312. However, in some embodiments, a distal end portion of the slot 330 encompassing the distal edge 340 can be characterized by a curvature away from the striking face 312 creating a larger distance D9 from the apex of the distal edge 340 to the inner wall 326 of the striking surface 312 compared to the distance D7 of front edge 334 of the slot 330 to the inner wall 326 of the striking surface 312. By having a distal end portion curve away from the striking face 312, the distal edge 340 can be a distance D9 of about 2.0 mm to about 12.0 mm away from the inner wall 326 of the striking surface 312. Preferably, the distal edge 340 can be a distance D9 of about 4.0 mm to about 10.0 mm away from the inner wall 326 of the striking surface 312. More preferably, the distal edge 340 can be a distance D9 of about 6.0 mm to about 8.0 mm away from the inner wall 326 of the striking surface 312.

The radius of curvature R1 of the front edge 334 of the distal end portion as it curves away from the striking surface 312 can be about 20.0 mm to about 40.0 mm. The radius of curvature R1 of the front edge 334 as it curves away from the striking surface 312 can be about 20.0 mm to about 40.0 mm. Preferably, the radius of curvature R1 of the front edge 334 as it curves away from the striking surface 312 can be about 23.0 mm to about 37.0 mm. More preferably, the radius of curvature R1 of the front edge 334 as it curves away from the striking surface 312 can be about 27.0 mm to about 33.0 mm. The radius of curvature R2 of the corresponding back edge 336 as it curves away from the striking surface 312 can be about 16.0 mm to about 39.0 mm. Preferably, the radius of curvature R2 of the back edge 336 as it curves away from the striking surface 312 can be about 19.0 mm to about 35.0 mm. More preferably, the radius of curvature R2 of the back edge 336 as it curves away from the striking surface 312 can be about 22.0 mm to about 32.0 mm.

In embodiments in which the distal edge 340 curves away from the striking surface 312 the height 116 of the distal edge 340 above the sole 302 (or the ground plane 10) may be about 4 mm to about 16 mm. Preferably, the height 116 of the distal edge 340 above the sole 302 may be about 6 mm to about 14 mm. More preferably, the height 116 of the distal edge 340 above the sole 302 may be about 8 mm to about 12 mm.

The slot 330 can also be characterized by its width W5 as measured from the front edge 334 to the back edge 336. The width W5 of the slot 330 can be about 1.0 mm to about 4.0 mm. Preferably, the width W5 of the slot 330 can be about 1.5 mm to about 3.5 mm. More preferably, the width W5 of the slot 330 can be about 2.0 mm to about 3.0 mm.

The slot 330 can further be characterized by its length L7 as measured from the proximal edge 338 to the distal edge 340. In the preferred embodiment, the slot 330 is generally stadium shape having a generally straight front edge 334 and a generally straight back edge 336 (aside from the curvature at the distal end in some embodiments) with curved proximal end 338 and distal end 340. However, the slot 330 can have other shapes, such as rectangular, oval, and other elongated shapes. The length L7 of the slot 330 can be about 55 mm to about 85 mm. Preferably, the length L7 of the slot 330 can be about 60 mm to about 80 mm. More preferably, the length L7 of the slot 330 can be about 65 mm to about 75 mm.

The insert 332 is shaped and dimensioned to fit inside the slot 330. As such, the shape and dimensions of the insert 332 is substantially the same as the slot 330. For example, the overall length L8 of the insert 332 can be about 55 mm to about 85 mm. Preferably, the overall length L8 of the insert 332 can be about 60 mm to about 80 mm. More preferably, the overall length L8 of the insert 332 can be about 65 mm to about 75 mm.

The insert 332 of the present embodiment can also have a height 117 as measured from the bottom of the insert 332 to the top of the insert 332 that can be less than about 5.0 mm. For example, the height 117 can be about 4.9 mm or less, 4.8 mm or less, 4.7 mm or less, and so on. Preferably, the height 117 of the insert 332 can be about 2.0 mm to about 4.5 mm. More preferably, the height 117 of the insert 332 can be about 2.5 mm to about 4.0 mm.

The golf club head 100 of the present invention can be manufactured using casting or forging technology according to the specification disclosed herein using materials such as titanium, steel, carbon fiber, and other typical metals used in manufacturing irons. Any of the inserts described herein can be fastened to the sole using adhesives, friction fit, catch type mechanisms, and the like. In the preferred embodiment, the insert is made with polymer material known in the art.

Examples

In one embodiment, a 3 iron was tested in which the front edge 334 of the slot 330 was approximately 2 mm or less from the inner wall 326 of the striking surface 312 (D7 less than or equal to about 2 mm). The proximal edge 338 of the slot 330 extended beyond the proximal end 328 of the striking face 312 by about 10 mm or less. The distal edge 340 of the slot 330 extended beyond the distal end 329 of the striking face 312 by about 10 mm or less. Compared to the control iron (3 iron without insert), this configuration placed the center of gravity in the x-direction (CGx) closer to the face center (by about 2 mm), in the y-direction (CGy) slightly lower (by about 0.4 mm), and in the z-direction (CGz) about the same. The coefficient of restitution (COR) was slightly higher in the present embodiment (0.823-0.825) compared to that of control (0.819).

The ball speed of the this embodiment was generally higher than control. The largest difference in ball speed was found at the lower toe region of the striking face 312. The middle (y direction) toe (x direction) region, the lower center region, and the middle center region also showed increase in ball speed. The heel region showed inconsistent results.

With respect to backspin on a golf ball struck with the current embodiment, the present embodiment showed increased backspin at the toe, center, and heel region of the striking face 312. In one comparison, the present invention generated a backspin that was more than 1000 rpm faster than control when measured at the lower and middle toe region, the lower and middle center region, and the lower and middle heel region.

In another 3 iron example in which the slot 330 extended from about the proximal end 328 of the striking surface 312 well into the toe portion 306, and approaching the topline 304 (i.e. the distal edge 340 of the slot 330 was above the face center), a comparison against a control 3 iron showed a slight increase in ball speed, particularly at the lower and middle toe region, and lower and middle center region, a slightly lower launch angle at the toe, center, and heel region, and increased backspin at the toe and center region.

As such, configurations of the present invention increased ball speed, increased backspin, and decreased loft angles.

Any of the features and characterizations of the example embodiments are not necessarily exclusive to the embodiments in which the features and characterizations were disclosed. The disclosure provides descriptions based on exemplary embodiments, and it is contemplated that features and characteristics in one exemplary embodiment can apply to any other embodiment.

Other than in the operating examples, or unless otherwise expressly specified, all of the numerical ranges, amounts, values and percentages such as those for radius of curvature, angles, and others in the aforementioned portions of the specification may be read as if prefaced by the word "about" or "approximately" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values, and any values in between any ranges cited, may be used.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A golf club head, comprising:

a) a striking face located at a frontal portion of the golf club head, the striking face having an outer wall, and an inner wall opposite the outer wall;

b) a back portion located opposite the striking face;

c) a heel portion located at a proximal end of the golf club head;

d) a hosel adjacent to the heel portion, the hosel defining a longitudinal axis and configured to receive a shaft;

e) a toe portion located at a distal end of the golf club head opposite the heel portion;

f) a topline located at an upper portion of the golf club head;

g) a sole located at a lower portion of the golf club head opposite the topline;

h) a slot defined in the sole; and i) an insert configured to fit inside the slot, j) wherein the slot defined by a front edge, a back edge opposite and behind the front edge, a proximal edge adjacent to the front edge and the back edge, and a distal edge opposite the proximal edge and adjacent to the front edge and the back edge, the slot having a length as measured from the proximal edge to the distal edge, and a width as measured from the front edge to the back edge, wherein the length of the slot is about 20 mm to about 85 mm, wherein the width of the slot is about 1 mm to about 13 mm, and wherein a distance from the front edge of the slot to the inner wall of the striking face is less than about 3.5 mm, wherein the insert defines a non-uniform height, and k) wherein a first height of the insert at a central portion is less than a second height of the insert at an end portion.

2. The golf club head of claim 1, wherein the central portion of the insert is recessed relative to a perimeter rim portion of the insert.

3. A golf club head, comprising:

a) a striking face located at a frontal portion of the golf club head, the striking face having an outer wall, and an inner wall opposite the outer wall;

b) a back portion located opposite the striking face;

c) a heel portion located at a proximal end of the golf club head;

d) a hosel adjacent to the heel portion, the hosel defining a longitudinal axis and configured to receive a shaft;

e) a toe portion located at a distal end of the golf club head opposite the heel portion;

f) a topline located at an upper portion of the golf club head;

g) a sole located at a lower portion of the golf club head opposite the topline;

h) a slot defined in the sole, the slot defined by a front edge, a back edge opposite and behind the front edge, a proximal edge adjacent to the front edge and the back edge, and a distal edge opposite the proximal edge and adjacent to the front edge and the back edge, the slot having a length as measured from the proximal edge to the distal edge, and a width as measured from the front edge to the back edge, wherein the length of the slot is about 20 mm to about 85 mm, wherein the width of the slot is about 1 mm to about 13 mm; and i) an insert having a length and a width configured to fit inside the slot, and a height measured at a central portion of the insert from a bottom surface to a top surface of the central portion of the insert, wherein the height of the central portion is less than about 5 mm, wherein the insert comprises a proximal end and a distal end with the central portion therebetween, wherein a height of the proximal end of the insert and a height of the distal end of the insert are each greater than the height of the central portion.

4. The golf club head of claim 3, wherein the height of the central portion of the insert is about 4.9 mm or less.

5. The golf club head of claim 3, wherein the height of the central portion of the insert is about 4.5 mm or less.

6. The golf club head of claim 3, wherein the height of the central portion of the insert is about 1.5 mm to about 2.5 mm.

7. The golf club head of claim 3, wherein the central portion is a recessed portion of the insert surrounded by a perimeter rim portion of the insert, wherein a height of the perimeter rim of the insert is greater than the height of the central portion.

8. The club head of claim 3, wherein a distal end portion of the slot passes into the toe portion and curves away from the striking surface, wherein the front edge at the distal end portion has a radius of curvature of about 20.0 mm to about 40.0 mm.

9. The club head of claim 3, wherein a distal end portion of the slot passes into the toe portion, and the distal edge terminates at a distal edge height of up to about 50 mm as measured from the sole portion to the distal edge.

10. A golf club head, comprising:

a) a striking face located at a frontal portion of the golf club head, the striking face having an outer wall, and an inner wall opposite the outer wall;

b) a back portion located opposite the striking face;

c) a heel portion located at a proximal end of the golf club head;

d) a hosel adjacent to the heel portion, the hosel defining a longitudinal axis and configured to receive a shaft;

e) a toe portion located at a distal end of the golf club head opposite the heel portion;

f) a topline located at an upper portion of the golf club head;

g) a sole located at a lower portion of the golf club head opposite the topline;

h) a slot defined in the sole, the slot defined by a front edge, a back edge opposite and behind the front edge, a proximal edge adjacent to the front edge and the back edge, and a distal edge opposite the proximal edge and adjacent to the front edge and the back edge, the slot having a length as measured from the proximal edge to the distal edge, and a width as measured from the front edge to the back edge, wherein the length of the slot is about 20 mm to about 85 mm, wherein the width of the slot is about 1 mm to about 13 mm; and i) an insert having a length and a width configured to fit inside the slot, and a height as measured from a bottom surface of the insert to a top surface of the insert, wherein the height is non-uniform when measured at different locations on the insert, j) wherein a first height measured at a central portion of the insert is less than a second height measured at an end portion of the insert.

11. The golf club head of claim 10, wherein a first height measured at a central portion of the insert is less than a second height measured at a rim of the insert that surrounds the central portion.

* * * * *